US006565335B1

(12) United States Patent
Yano et al.

(10) Patent No.: US 6,565,335 B1
(45) Date of Patent: May 20, 2003

(54) VERTICAL PUMP

(75) Inventors: Yoshio Yano, 4-20, Fukamachi 1-chome, Wakamatsu-ku Kitakyushu-shi, Fukuoka 808-0012 (JP); Isamu Aotani, 21-32, Hanaminosato 3-chome, Fukuma-machi Munakata-gun, Fukuoka 811-3215 (JP); Yoshikazu Yasuda, Fukuoka (JP)

(73) Assignees: Yoshio Yano, Kitakyushu (JP); Isamu Aotani, Munakata (JP); Kurosaki Corporation, Kitakyushu (JP)

( * ) Notice: Subject to any disclaimer, the term of this patent is extended or adjusted under 35 U.S.C. 154(b) by 0 days.

(21) Appl. No.: 09/868,520

(22) PCT Filed: Sep. 25, 2000

(86) PCT No.: PCT/JP00/06570

§ 371 (c)(1),
(2), (4) Date: Jun. 19, 2001

(87) PCT Pub. No.: WO01/31203

PCT Pub. Date: May 3, 2001

(30) Foreign Application Priority Data

Oct. 21, 1999 (JP) ..... 11-338380
Feb. 18, 2000 (JP) ..... 2000-105668

(51) Int. Cl.[7] ..... F04B 17/00; F04B 35/04
(52) U.S. Cl. ..... 417/424.1; 324/207.17
(58) Field of Search ..... 417/424.1, 424.2, 417/423.7, 413.1, 420, 72, 423.4, 368, 417, 419; 310/68 R; 324/207.17

(56) References Cited

U.S. PATENT DOCUMENTS 3,841,798 A * 10/1974 Rehfeld ..... 417/419
3,849,031 A * 11/1974 Charboneau et al. ..... 414/417
4,065,232 A * 12/1977 Stratienko ..... 417/368
4,116,592 A * 9/1978 Cherny et al. ..... 417/423.4
4,415,308 A * 11/1983 Maruyama et al. ..... 417/72
4,684,333 A * 8/1987 Hirakawa et al. ..... 417/420
4,874,299 A * 10/1989 Lopez et al. ..... 417/413.1
5,567,133 A * 10/1996 Kobaybash et al. ..... 417/423.7
5,925,951 A * 7/1999 Edwards et al. ..... 310/68 R
5,955,880 A * 9/1999 Beam et al. ..... 324/207.17
6,071,093 A * 6/2000 Hart ..... 417/424.2

* cited by examiner

*Primary Examiner*—Teresa Walberg
*Assistant Examiner*—Leonid Fastovsky
(74) *Attorney, Agent, or Firm*—Snider & Associates; Ronald R. Snider

(57) ABSTRACT

A vertical pump which has a rotating body having an impeller arranged with its axial center being vertical, and a cylindrical rotor fixed to an upper portion of the impeller with their axial center being, aligned with each other. A main portion of the cylindrical rotor is composed of a good conductor. A casing for housing the rotating body with a gap rotatively and a rotary magnetic field generator facing the cylindrical rotor for applying a rotational force, to the cylindrical rotor are provided. As a result, the rotating body including the impeller and the cylindrical rotor is rotated without contacting with the casing.

24 Claims, 33 Drawing Sheets

(A)

(B)

(A)

(B)

(A)

(B)

VERTICAL PUMP

This application claims the priorities of Japanese Patent Application No. HEISEI 11-338380 filed on Oct. 21, 1999 and Japanese Patent Application No. 2000-105668 filed on Feb. 18, 2000, which are incorporated herein by reference.

FIELD OF THE INVENTION

This invention relates to a vertical pump, particularly improvement of a vertical pump having an impeller without a driving shaft.

BACKGROUND OF THE INVENTION

A general liquid pump is provided with a driving shaft at a rotational center of an impeller arranged in a casing, and the driving shaft is driven to be rotated by a motor so that a liquid is sent. Therefore, a bearing for supporting the driving shaft to the casing rotatively, and a seal mechanism for preventing an inner liquid from flowing out from the bearing portion were required. Causes of malfunction of a pump are mostly centered at the seal mechanism and the bearing portion.

Particularly in the case where a liquid sucked up by a pump contains a solid component such as sludge, this sludge penetrates into bearing and seal portions and abnormal abrasion occurs, and there arises a problem that a life of the pump is shortened.

It has been a long time since a seal-less pump in which the seal is eliminated and risk of liquid leakage is lowered was developed. As this seal-less pump, there are a canned motor pump and a magnet pump having an impeller, and a diaphragm pump for sending a liquid by means of reciprocation of a film.

In the canned motor pump or the magnet pump, a driving shaft and a bearing exist in a liquid. For this reason, normal lubricant cannot be used for a bearing portion, and a transfer liquid functions as lubricant and coolant, and it is unavoidable that abrasion chips of the shaft and bearing are mixed in the transfer liquid. Moreover, idling without a liquid occasionally causes a damage to the bearing.

This becomes a big problem particularly in the case where these pumps are used as a pump for sending a cleaning super pure water which is used a lot at the time of producing a semiconductor.

Meanwhile, since a driving shaft and a bearing do not exist in a liquid in the diaphragm pump, a discharged liquid is not polluted much, but the discharged liquid is pulsated and a film easily malfunctions. Furthermore, a pump head can be high but a discharge amount is small. As a result, in the case where a lot of transfer is executed, this pump becomes extremely more expensive than another pumps.

SUMMARY OF THE INVENTION

The present invention is devised in order to solve the above problems in the prior arts, and its object is to provide a vertical pump in which a discharged liquid is hardly pulsated and polluted and efficiency is high.

In order to achieve the above-mentioned object, the present invention provides a vertical pump, comprising: a rotating body having an impeller arranged with its axial center being vertical, and a cylindrical rotor fixed to an upper portion of said impeller with their axial center being aligned with each other, a main portion of said cylindrical rotor being composed of a good conductor; a casing for housing said rotating body with a gap rotatively; and rotation magnetic field generating means for applying a rotational force to said cylindrical rotor, said means facing said cylindrical rotor.

Preferably, in the present invention, wherein said casing includes: an impeller chamber having a suction port at its lower center and a discharge port at its side portion, said impeller chamber for storing said impeller; and a rotor housing having an inner cylinder and an outer cylinder made of non-magnetic high-electric resistant materials, and a cover section for covering upper portions of said cylinders, said cylindrical rotor being arranged between said inner cylinder and said outer cylinder with a gap rotatively, said rotor housing being connected integrally with the upper portion of said impeller chamber.

Preferably, in the present invention, wherein said rotation magnetic field generating means includes inner rotation magnetic field generating means and outer rotation magnetic field generating means, for applying rotational forces to said cylindrical rotor, which are arranged so as to respectively face an outer side of said outer cylinder and an inner side of said inner cylinder.

Preferably, in the present invention, wherein a magnetic cylinder is arranged on said cylindrical rotor concentrically, and an up-and-down position of a cross sectional centroid of the magnetic cylinder in the state that said cylindrical rotor is stopped is in a center position of said rotation magnetic field generating means in the up-and-down direction, and said cylindrical rotor is driven to be rotated, and the rotating body including said cylindrical rotor rises.

Preferably, in the present invention, wherein lengths of cores in the up-and-down direction forming polarities of said outer rotation magnetic field generating means and said inner rotation magnetic field generating means are the same, and those means are in the same level, and lengths of the cores and said magnetic cylinder in the up-and-down direction are equal to each other, and said magnetic cylinder is embedded concentrically from top of said cylindrical rotor, and said magnetic cylinder is in a thickness-wise center position of said cylindrical rotor.

Preferably, in the present invention, wherein clean liquid supply means having an introduction hole is provided to an upper position of said rotor housing so as to supply a clean liquid from an upper portion of said rotor housing.

Preferably, in the present invention, wherein said clean liquid supply means has a filter which filtrate a transfer liquid discharged from the discharge port of said outer casing so that the transfer liquid filtrated by the filter is supplied to the upper portion of the rotor housing.

Preferably, in the present invention, wherein said inner rotation magnetic field generating means and said outer rotation magnetic field generating means are composed of an inner stator and an outer stator which allows alternating currents to flow so as to generate rotation magnetic fields.

Preferably, in the present invention, wherein a cooling tank where the inner stator and the outer stator are cooled by an insulating liquid is provided, and cooling means for cooling the insulating liquid is provided to the cooling tank.

Preferably, in the present invention, wherein the cooling means for cooling the inner stator has a cooler and a circulating pump of the insulating liquid.

Preferably, in the present invention, wherein said inner rotation magnetic field generating means and said outer rotation magnetic field generating means are composed of an inner magnet and an outer magnet which are driven to be rotated by a motor, and said motor is rotated so as to apply a rotational force to said cylindrical rotor.

Preferably, in the present invention, wherein a bottom plate which is supported by a supporting cradle is provided to said rotor housing, and an impeller casing section, which covers said impeller from a lower part so as to form said impeller chamber is attached to the bottom plate in a covered state.

Preferably, in the present invention, wherein a first annular magnet is provided to the upper portion of said impeller, and a second annular magnet which repulses said first annular magnet is provided to a lower portion of said inner bottom plate of said inner cylinder facing the upper portion of said impeller.

Preferably, in the present invention, further comprising: a movable annular magnet arranged around a suction passage of the lower portion of said impeller: and a fixed annular magnet arranged to the impeller casing section and facing said movable annular magnet, wherein said movable annular magnet and said fixed annular magnet repulse each other on their countered surfaces.

Preferably, in the present invention, wherein an aileron which pushes out a liquid at the upper portion of said impeller by rotation of said impeller is formed on an upper surface of said impeller main plate.

Preferably, in the present invention, wherein a resistant cylinder which projects downward is formed on a lower surface of said rotor housing.

Preferably, in the present invention, wherein said impeller main plate has an opening whose center is a rotational axis of the plate, and an equalizer plate which is hung from a lower surface of said rotor housing is provided to the opening.

Preferably, in the present invention, further comprising: a movable aileron which is projected from said rotating body to a peripheral direction: and a fixed aileron which is projected from said casing inwardly are provided, wherein an area of countered portions of said movable aileron and said fixed aileron changes by up-and-down movement of said impeller, and when said impeller moves upward, the area of the countered portions decreases and a transfer amount of the liquid into the upper portion of said impeller increases, and when said impeller moves downward, the area of the countered portions increases and a transfer amount of the liquid into the upward portion of said impeller decreases.

Preferably, in the present invention, comprising: an upper pressure sensor for detecting a liquid pressure on the upper portion of said impeller; a lower pressure sensor for detecting a liquid pressure between the lower portion of said impeller and said impeller casing section; a pressure adjusting tube for, when a difference ($P_1$–$P_2$) between the upper pressure $P_1$ and the lower pressure $P_2$ becomes larger than a fixed value δP, discharging the liquid on the upper portion of said impeller, and when the difference ($P_1$–$P_2$) becomes smaller than the fixed value δP, feeding a liquid to the upper portion of said impeller; and a controller for controlling the discharge and feeding by means of said pressure adjusting tube.

DETAILED DESCRIPTION OF THE PREFERRED EMBODIMENT

There will be explained below preferred embodiments of the present invention with reference to the drawings.

First Embodiment

Figure 1:
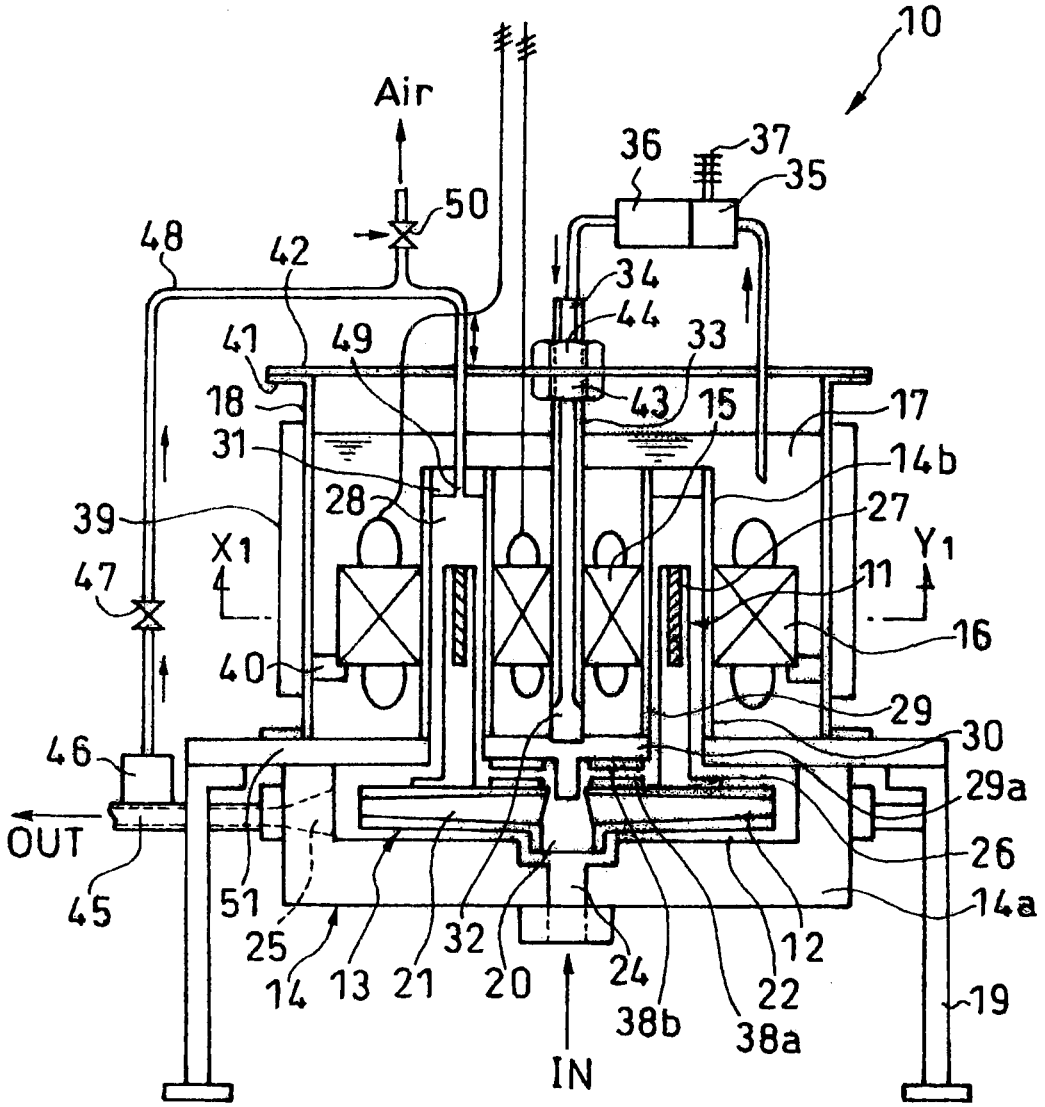
FIG. 1 is across section of a vertical pump according to a first embodiment of the present invention.
Figure 2:
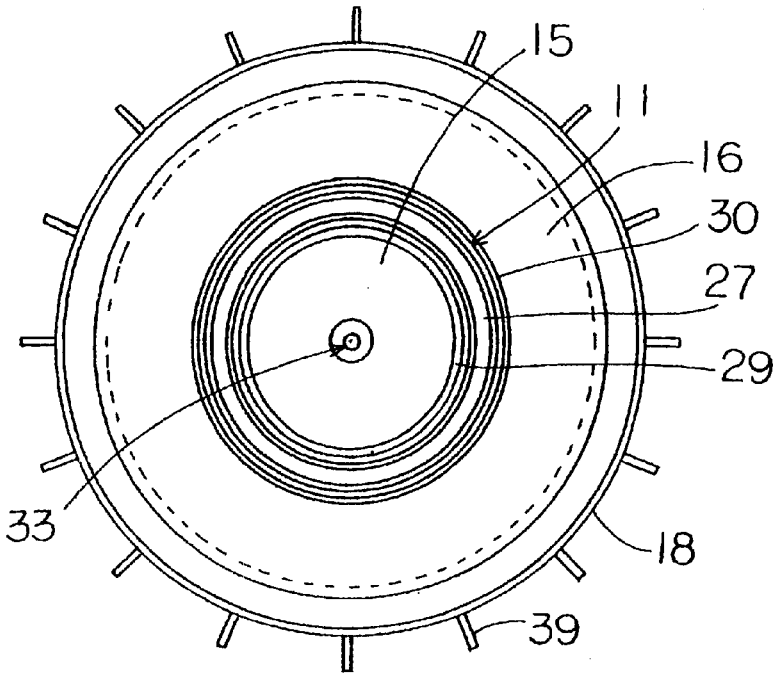
FIG. 2 is a cross section taken along X1-Y1 of the vertical pump shown in FIG. 1.

FIG. 1 is a cross section of a vertical pump according to a first embodiment of the present invention. FIG. 2 is a cross section taken along line X1-Y1 of FIG. 1.

In the drawings, the vertical pump 10 has: a rotating body 13 having an impeller 12 to which a cylindrical rotor 11 is attached to its upper part; rotation magnetic field generating means which is composed of an outside casing 14 for supporting the rotating body 13 rotatively, an inner stator 15 and an outer stator 16 for giving rotation magnetic fields to the cylindrical rotor 11; a cooling tank 18 for storing insulating oil 17 for cooling the inner stator 15 and the outer stator 16; and a supporting cradle 19 for supporting the cooling tank 18.

Similarly to an impeller of a normal liquid pump, the impeller 12 is formed by stainless, cast steel, cast iron, synthetic resin or the like, and it is arranged so that its axial center as a rotational center is vertical.

The impeller 12 has a suction passage 20 at its lower-center portion, and a discharge passage 21 radially around the impeller. The impeller 12 is arranged in an impeller chamber 22 rotatively. When the impeller is rotated at a high speed, it sucks a transfer liquid sucked from a suction port 24 at a center bottom portion of an impeller casing section 14*a* of the outer casing 14, and discharges the transfer liquid to a circumference by means of a centrifugal force so as to send the transfer liquid from a discharge port 25 formed on one side of a radially outside direction of the impeller casing section 14*a*.

As shown in FIG. 1, the cylindrical rotor 11 is attached to an upper part of the impeller 12 via a ring-shaped flange 26. A main material of the cylindrical rotor 11 is a non-magnetic good conductor such as aluminum or copper, and a magnetic cylinder 27 whose material is iron as one example of the magnetic member is embedded into a middle position in a thickness-wise direction from above concentrically.

An upper portion of the outer casing 14 composes a rotor casing section 14*b*, and a rotor housing 28 for sealing and housing the cylindrical rotor 11 is provided integrally with an upper portion of the impeller chamber 22 in the rotor casing section 14*b*. The rotor casing section 14*b* is composed of an inner cylinder 29 and an outer cylinder 30 whose peripheral walls are made of non-magnetic and high electrical resistance material (such as stainless plate, resin having sufficient strength), and a cover section 31 for closing the upper portion of the rotor casing section 14*b*. The cylindrical rotor 11 is arranged rotatively in a middle position between the inner cylinder 29 and the outer cylinder 30 so as to provide a slight gap from both of them. In such a manner, the outer casing 14 is composed of the rotor casing section 14*b*, a part of a bottom plate, an inner bottom plate 38*a* and the impeller casing section 14*a*.

As shown in FIGS. 1 and 2, the inner stator 15 is arranged in the inner cylinder 29 and the outer stator 16 is arranged outside of the outer cylinder 30 so that their opposed poles are different. The inner stator 15 and the outer stator 16 have the same structure as that of a stator of a well-known induction motor and are constituted so that a coil is wound around a laminated iron core and a plurality of poles are provided. A multi-phase alternating current (for example, three-phase alternating current) is allowed to flow in a specified direction so that a magnetic field which passes through the cylindrical rotor 11 is rotated.

Figure 3:
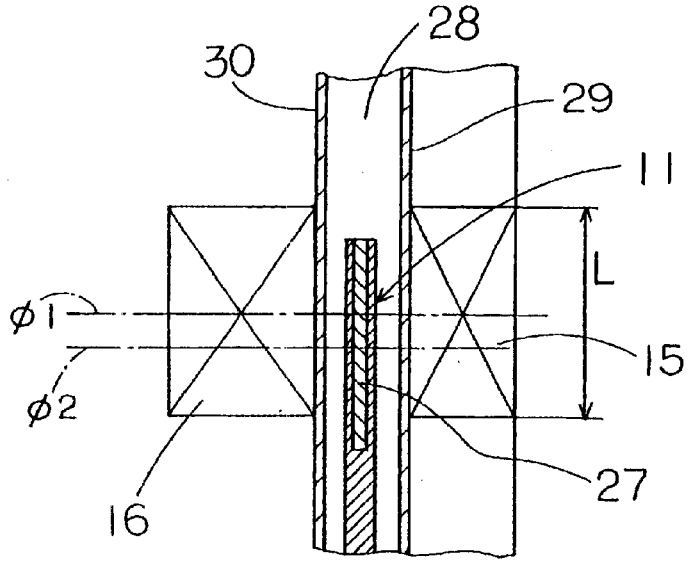
FIG. 3 is a partially enlarged cross section showing a mounted state of a cylindrical rotor periphery in the vertical pump according to the first embodiment of the present invention.

FIG. 3 is a partial cross section showing a mounted state of a cylindrical rotor periphery of the vertical pump according to the first embodiment. As shown in this drawing, cores which form respective magnetic poles of the inner stator 15 and the outer stator 16 have the same width L in an up-and-down direction and are provided in the same-level positions. A magnetic field center position Φ1 is in a position slightly above (for example, about 2 to 3 mm) a magnetic field center position Φ2, which is a cross section centroid position of the magnetic cylinder 27 of the cylindrical rotor 11 in a standstill state. The magnetic field center position Φ2 of the magnetic cylinder 27 becomes a center position of the magnetic cylinder 27 in the up-and-down direction, and a length of the magnetic cylinder 27 in the up-and-down direction is the same as the length L of the cores of the inner stator 15 and the outer stator 16 in the up-and-down direction. In the case where a rotation magnetic field is generated in the inner stator 15 and the outer stator 16, a suction force is generated in the magnetic cylinder 27, and the rotating body 13 having the magnetic cylinder 27 rises. Even if a transfer liquid does not exist in the outer casing 14, the rotating body 13 can rotate at a high speed without contacting with the bottom portion and side wall of the outer casing 14.

As shown in FIG. 1, the inner stator 15 and the outer stator 16 are soaked in the cooling tank 18 into which the insulating oil 17 was poured. Since the inner stator 15 is surrounded by the inner cylinder 29, a supporting pipe 33 having an exhaust port 32 is provided to a center-lower portion of the inner stator 15 so that the insulating oil 17 in the cooling tank 18 is forcibly circulated from an oil feed port 34 at the upper portion of the supporting pipe 33 via a heat pipe air cooling type cooler 35 as one example of cooling means and a circulating pump 36. Here, the cooler 35 is provided with a heat pipe 37 and a feed tube. The supporting pipe 33 is attached to an inner bottom plate 29*a* provided at the bottom portion of the inner cylinder 29, and supports the inner cylinder 29 and the inner stator 15.

First and second annular magnets 38*a* and 38*b* which face each other at the same poles are provided to an upper portion of the impeller 12 and a lower portion of the inner bottom plate 29*a* so that their axial center are aligned with each other. These magnets always repulse each other, and the upper portion of the impeller 12 does not contact with the lower portion of the inner bottom plate 29*a*.

As shown in FIG. 2, a lot of fin plates 39 as one example of cooling means are provided around the cooling tank 18, and they prevent a rise in temperature of the insulating oil 17. As shown in FIG. 1, a supporting member 40 for supporting the outer stator 16 is provided to a suitable place inside the cooling tank 18. A cover 42 which is fixed to the flange 41 via a screw is provided to the upper portion of the cooling tank 18, and the supporting pipe 33 is inserted through the center of the cover 42 so as to be fixed to the center of the cover 42 by nuts 43 and 44 which are screwed into the supporting pipe 33.

A branch tube (not shown) for supplying a transfer liquid via a filter 46 is provided to a pipe arrangement 45 of the discharge port 25. The clean liquid which passed through the filter 46 is supplied to an introduction port 49 of the cover section 31 via a transfer liquid tube 48 provided with an on-off valve 47 in its middle position from the upper portion of the rotor housing 28. As a result, sludge or refuse is not supplied into the rotor housing 28, and the rotor housing 28 is always in a clean state. Another on-off valve 50 is provided to a top portion of the transfer liquid tube 48 so that air collected in the pipe arrangement and the rotor housing 28 can be discharged. In such a manner, the clean liquid supply means is composed of the filter 46, the on-off valve 47 and the transfer liquid tube 48.

The supporting cradle 19 is formed by a material having sufficient strength such as stainless or steel, and supports a bottom plate 51 of the cooling tank 18. The impeller casing section 23 forming the impeller chamber 22 of the outer casing 14 is attached to the bottom plate 51 so as to cover the impeller 12 from the bottom. Moreover, the outer cylinder 30 is attached to the bottom plate 51 so that their axial center are aligned with each other. Here, when the impeller casing section 23 is removed, the rotating body 13 therein is taken out downward so that the inside of the pump and the rotating body 13 can be cleaned and maintained.

Therefore, in the vertical pump 10, when an alternating current is allowed to flow through the inner stator 15 and the outer stator 16 in a state that the insulating oil 17 is in the cooling tank 18, a rotation magnetic field is generated, and a rotational force is applied to the cylindrical rotor 11 and a repulsion force is applied from inwardly and outwardly radial directions to the cylindrical rotor 11. In this case, since the magnetic cylinder 27 is provided in the cylindrical rotor 11, even if the no-load operation is performed, the cylindrical rotor 11 rises so that the center position Φ2 of the magnetic cylinder 27 in the up-and-down direction (namely, magnetic field center position) coincides with the center positions Φ1 of the inner stator 15 and the outer stator 16 in the up-and-down direction (namely, the magnetic field center position). As a result, the impeller 12 and the cylindrical rotor 11 which rises in the outer casing 14 are driven to be rotated, and there is an advantage that both in the loading and no-loading states, the impeller 12 can rotate in no-contact with the inner side of the outer casing 14.

The transfer liquid is supplied to the suction port 24 via a pipe and a horse, not shown, so as to be sucked thereto and discharged from the discharge port 25. When the on-off valve 47 is opened, a part of the transfer liquid discharged from the discharge port 25 is cleaned by the filter 46 so as to be supplied to the upper portion of the rotor housing 28. As a result, since the clean transfer liquid flows from up to down in the rotor housing 28, a transfer liquid containing sludge or the like does not penetrate from the lower portion of the rotor housing 28 so that abrasion of the cylindrical rotor 11 due to sludge or the like can be prevented.

Since the inner stator 15 and the outer stator 16 are always cooled by the insulating oil 17, they can be maintained in suitable temperature.

Next, there will be explained below the vertical pump lo according to a modified example of the present embodiment with reference to FIGS. 4 through 6. Here, the same reference numerals are given to portions corresponding to those in the pump 10 of the above-mentioned first embodiment, and the description thereof is omitted.

The characteristic of the pump of this modified example is that the static inner stator 15 and the outer stator 16 which allow an alternating current to flow are used as rotation magnetic field generating means in the above-mentioned pump, but magnets which are driven to be rotated by a motor are used as rotation magnetic field generating means in the vertical pump 10 of the modified example.

Figure 4:
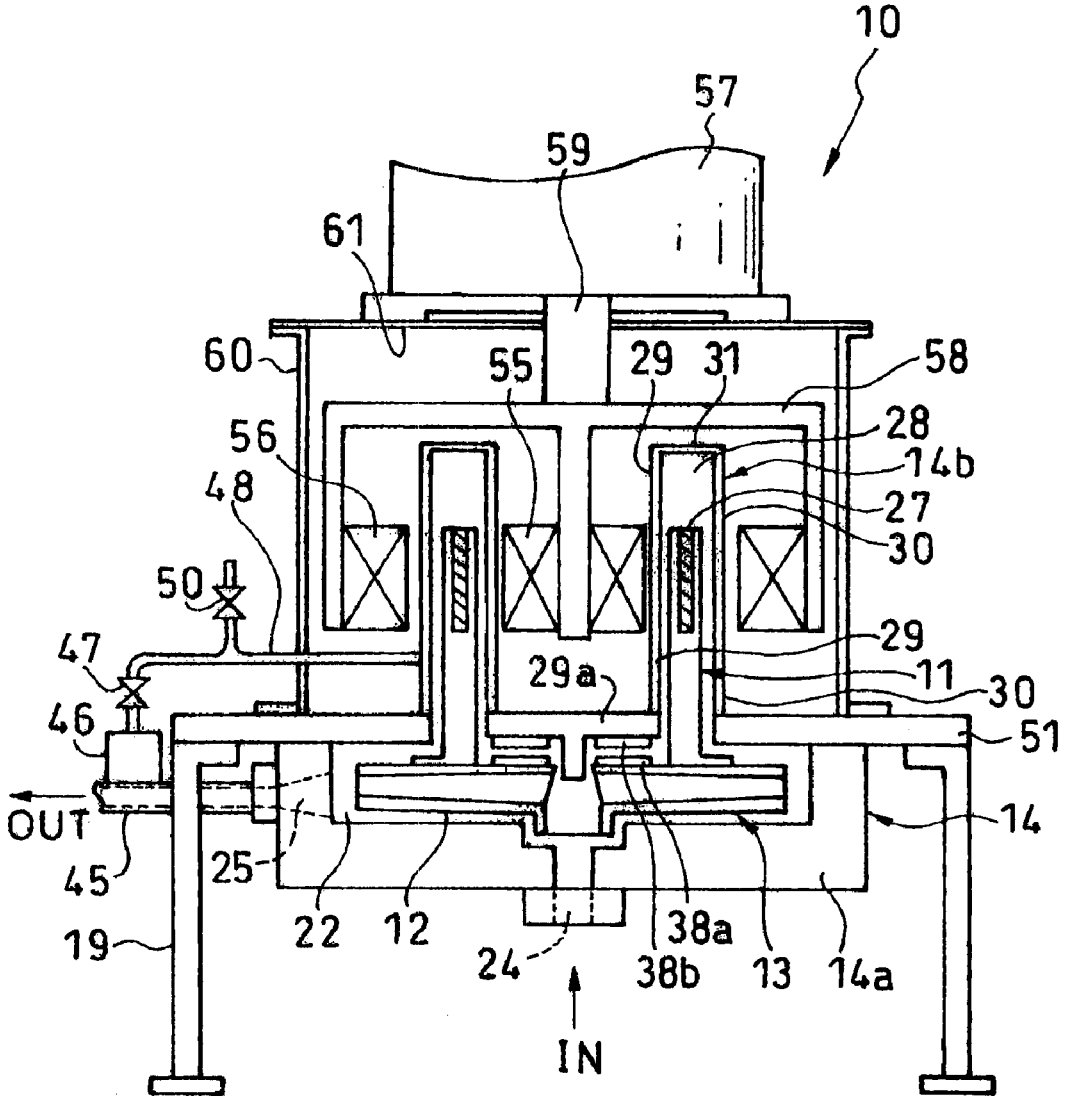
FIG. 4 is a partially-omitted substantial cross section of the vertical pump of a modified example according to the first embodiment of the present invention.
Figure 5:
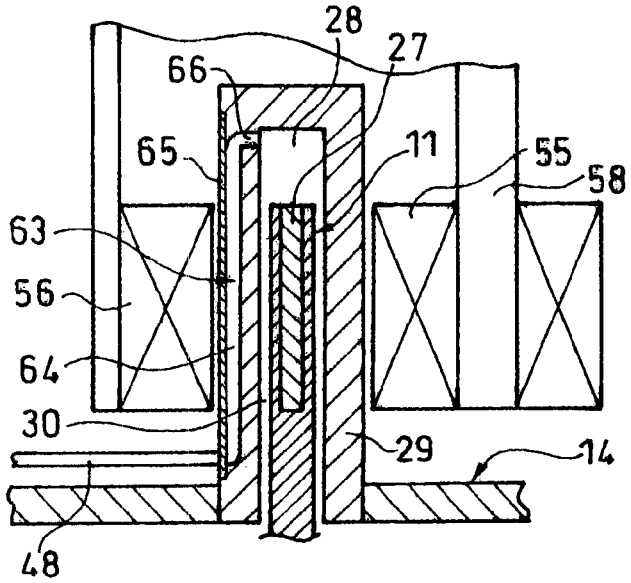
FIG. 5 is a partially-enlarged cross section showing a mounting state of the cylindrical rotor periphery in the pump shown in FIG. 4.
Figure 6:
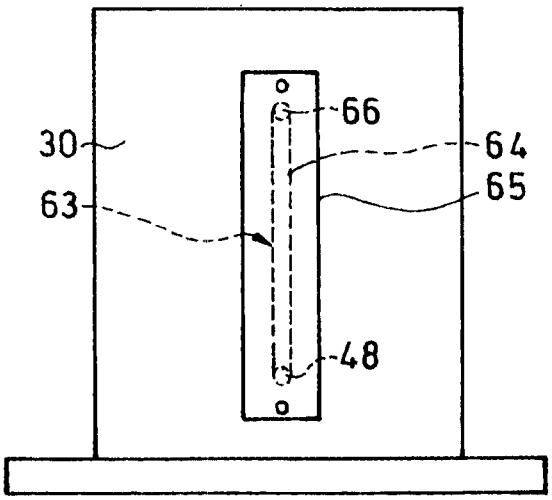
FIG. 6 is an explanatory diagram of clean liquid supply means to be used for the pump according to the first embodiment.

As shown in FIGS. 4 through 5, the vertical pump 10 according to the present embodiment has the rotating body 13 with the impeller 12 in which the cylindrical rotor 11 is attached to its upper portion, the outer casing 14 for housing the rotating body 13 rotatively, an inner magnet 55 and an outer magnet 56 which are examples of the rotation magnetic field generating means for applying a rotation magnetic field to the cylindrical rotor 11, and a motor 57 which rotates the magnets synchronously, and a supporting cradle 60 for supporting them.

The rotor casing section 14*b* forming the rotor housing 28, a part of the bottom plate 51, the inner bottom plate 29*a* and the impeller casing section 14*a* compose the outer casing 14. The rotor housing 28 is formed so as to be surrounded by the inner cylinder 29 and the outer cylinder 30 made of non-magnetic and high-resistant material (such as a stainless plate or a resin plate), and the cover section 31 which blocks ceiling portions of both the cylinders.

The inner magnet 55 and the outer magnet 56 which are supported by one supporting member 58 are provided to the inside of the inner cylinder 29 and the outside of the outer cylinder 30 with slight gaps. The inner magnet 55 and the outer magnet 56 are composed of a plurality of permanent magnets which are provided in a circumferential direction with small gaps, and the respective permanent magnets are provided so that the opposed poles face one another centered on the cylindrical rotor 11. The supporting member 58 which supports unopposed pole sides of the inner magnet 55 and the outer magnet 56 is preferably made of a magnetic body such as iron, and it is preferable that the supporting member supports the inner magnet 55 and the outer magnet 56 firmly and forms their outer magnetic paths. A rotation driving shaft 59 is provided to the upper portion of the supporting member 58 and is connected to an output shaft of the motor 57 by a coupling or the like, not shown. The rotation driving shaft 59 is supported rotatively by a bearing, not shown.

The inner magnet 55 and the outer magnet 56 have cores (namely, magnet bodies) whose lengths in the up-and-down direction are the same, and they are mounted at the same level in the up-and-down direction. Their magnetic center positions in the up-and-down direction are set to be slightly higher (about 2 to 3 mm) than the center position in the up-and-down direction of the magnetic cylinder 27 of the cylindrical rotor 11 composing the rest rotating body 13 placed on the bottom portion of the impeller chamber 22. The magnetic cylinder 27 is attracted by the inner magnet 55 and the outer magnet 56, and the cylindrical rotor 11 rises in the outer casing 14.

A base end of a cover 60 covering the outside of the outer magnet 56 is attached to the bottom plate 51, and the circumference of the bottom plate 51 is attached to the supporting cradle 19. The cover 60 is made of a member having sufficient strength and is provided with a cover plate 61 at its upper portion, and the motor 57 is attached onto the cover plate 61. Here, the impeller casing section 14*a* is fixed to the bottom plate 51 with screws.

As the clean liquid supply means for supplying a clean liquid, the filter 46, the on-off valve 47 and the transfer liquid tube 48 are used in the rotor housing 28. As shown in FIGS. 5 and 6, the supply means is composed of a liquid passage section 63 formed on the outer cylinder 30. The liquid passage section 63 is formed so that a vertical groove 64 is formed from the outside onto the outer cylinder 30 with larger thickness and a groove cover 65 is put on the vertical groove 64. A small hole 66 which is connected with the upper portion of the rotor housing 28 inside is formed at an upper end portion of the vertical groove 64, and a lower portion of the vertical groove 64 is connected to with the transfer liquid tube 48 from the outside.

As a result, even in the case where the rotating outer magnet 56 and supporting member 58 exist outside and above the outer cylinder 30, a clean transfer liquid can be fed to the upper portion of the rotor housing 61 without obstruction. An air taking-out on-off valve 50 is provided to the transfer liquid tube 48. Moreover, as the clean liquid supply means, a rotary joint is used so that the clean liquid can be supplied via the rotation driving shaft 59.

In addition, the second annular magnet 38*b* which repulses the first annular magnet 38*a* attached to the upper portion of the impeller 12 is provided to the bottom portion of the inner bottom plate 29*a* of the inner cylinder 29 so as to prevent contact between the impeller 12 and the inner bottom plate 29*a*.

Therefore, in the vertical pump 10, the motor 57 is rotated so as to rotate the inner magnet 55 and the outer magnet 56. As a result, a rotation magnetic field is generated, and a rotational force is generated in the cylindrical rotor 11 so that the rotating body 13 in which the cylindrical rotor 11 is integral with the impeller 12 is driven to be rotated.

In this case, the operation that a clean transfer liquid is supplied to the rotor housing 28, and the operation that the cylindrical rotor 11 rises and rotates in the outer casing 14 are the same as those of the vertical pump shown in FIG. 1.

Here, in the case where the rotating body 13, which includes the impeller 12 and the cylindrical rotor 11, and the outer casing 14 are cleaned and maintained, the impeller casing section 14*a* is removed and the rotating body 13 is pulled out.

There will be explained below concrete major items of the vertical pump according to the above embodiment.

Vertical Pump in FIG. 1

1. Specifications of inner stator 15 and outer stator 16
   The inner and outer stators 15 and 16, which are of three-phase, 60 Hz, 2P (poles) and 2.2 Kw, were connected in a series.
2. Material, thickness and gap of inner cylinder 29 and outer cylinder 30
   Two kinds of materials: stainless (SUS304) with a thickness of 1 mm; and polycarbonate with a thickness of 2.5 mm were used, and they could be operated without obstruction.
3. Structure of cylindrical rotor 11
   An aluminum cylinder was used as a good conductor portion, and normal steel (SS400) with a thickness of 3 mm was used as the magnetic cylinder 27.
4. Used insulating oil
   Fire-resistant silicone oil was used. The oil was saturated at a temperature of about 60° C. during operation.
5. Pump capacity
   A pump head was 15 to 20 m at 250 to 300 L/min.

Vertical Pump in FIG. 4

1. Specifications of inner magnet 55 and outer magnet 56
   Rare earth magnets in which a number of poles are 8P (poles) were used. As the motor 57 for driving them, an induction motor of 2P and 2.2 Kw was used.
2. Material, thickness and gap of inner cylinder 29 and outer cylinder 30
   Polycarbonate with a thickness of 4 mm was used for the inner cylinder 29 and the outer cylinder 30, and the gap therebetween was 8 mm.
3. Structure of cylindrical rotor 11
   An aluminum cylinder was used as a good conductor portion, and normal steel (SS400) with a thickness of 3 mm was used as the magnetic cylinder 27.
4. Pump capacity
   A pump head was 20 to 30 m at 200 to 300 L/min.

The vertical pumps in FIGS. 1 and 4 are produced under the above items, and the test results of the operation are shown below.

1. SiC powder with a particle diameter of 150 $\mu$m of about 3% was mixed into a transfer liquid, and the pumps were operated. After 24-hour operation, abrasion of the inner cylinder 29 and the outer cylinder 30 was not recognized.
2. The pumps were idled without supplying a transfer liquid to the vertical pump 10 for one minute, and the idling was repeated three times. However, an abnormal sound was not generated, and the cylindrical rotor 11, the impeller 12 and the outer casing 14 were not abraded.

Second Embodiment

There will be explained below the second embodiment of the present invention with reference to FIGS. 7 through 25. Here, reference numerals where 100 is added to the numerals in the first embodiment are given to parts corresponding to those in the first embodiment, and the description thereof is omitted.

The characteristic of the present embodiment is that the outer stator and the inner stator were used in the first embodiment, but only an outer stator 116 (rotation magnetic field generating means) which is positioned on an outer periphery of a rotor 111 is used so as to apply a rotational force to the rotor 111 in the present embodiment.

Figure 7:
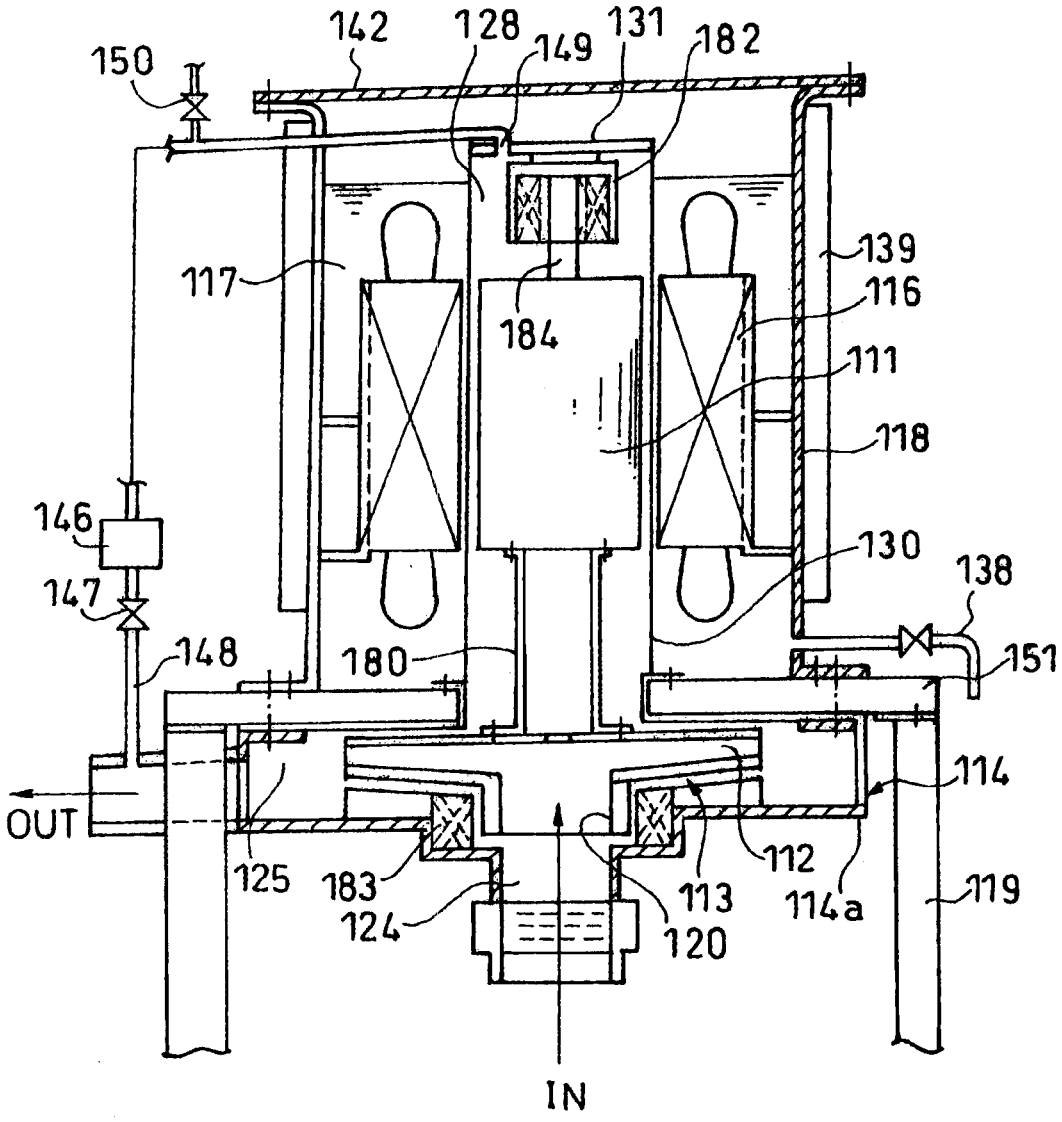
FIG. 7 is a cross section of the vertical pump according to a second embodiment of the present invention.

Namely, as is clear from FIG. 7, the rotor 111 is provided to an upper portion of an impeller 112 via a stanchion 180.

An upper magnet mechanism 182 is provided to a lower surface of a cover 131, and a lower magnet mechanism 183 is provided to an inner periphery of an intake port 124 of the impeller 112 so that stable rotation of a rotating body 113 is maintained.

Figure 8:
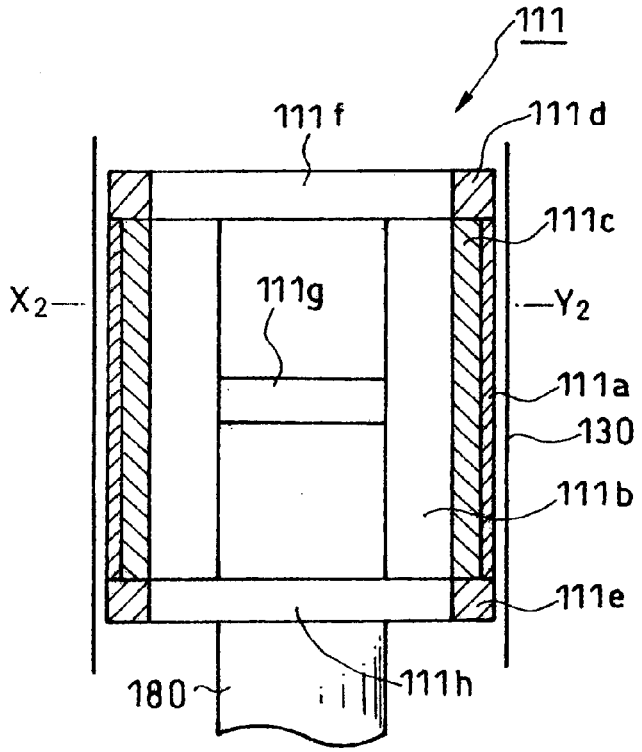
FIGS. 8 and 9 are explanatory diagrams of rotors to be used in the pump according to the second embodiment.
Figure 9:
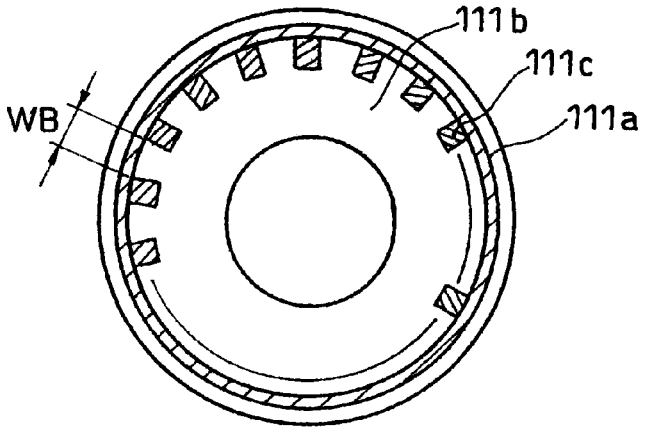

FIGS. 8 and 9 show detailed structures of the rotor 111 which are distinctive in the present embodiment, FIG. 8 is a longitudinal section of the rotor 111, and FIG. 9 is a cross section taken along line X2-Y2 of FIG. 8.

As shown in FIG. 8, the rotor 111 includes a copper cylinder 111*a* which is arranged on its outermost periphery, and an iron cylinder 111*b* which is arranged on an inner side of the copper cylinder 111*a* and has a thickness for not allowing magnetic flux from a stator 116 to be saturated. A plurality of copper bars 111*c* are inserted into a peripheral edge of the iron cylinder 111*b*, and the copper cylinder 111*a* and the copper bars 111*c* are fixed to the upper and lower surfaces of the rotor 111 by copper rings 111*d* and 111*e*. The copper rings 111*d* and 111*e* serve as end rings of a rotor of a general-purpose motor.

The copper cylinder 111*a* is provided to the outermost portion because a repulsion force against the stator 116 is generated. The copper cylinder 111*a* and the copper bars 111*c* become a conductor portion of the rotor 111, and electric resistance is determined by its volume. Here, the conductor portion is not limited to copper, and metal such as aluminum may used. Moreover, a center of the iron cylinder as a magnetic body is a space in order to reduce the weight of the rotor 111 and obtain buoyancy in a liquid due to this space. The center space is connected with the disc-shaped iron connecting plates 111*f*, 111*g* and 111*h* at upper, lower and center portions. This connection forms a magnetic path at the time of two poles, and an exciting current of the stator 116 can be reduced a lot. A magnetic gap (g0) in this case can be 2.5 to 3.5 mm, namely, it can be reduced to not more than ½ of the value in the first embodiment.

In addition, magnetic body widths (WB) among the copper bars 111*c* are such that a magnetic flux from the stator 116 can be allowed to pass therethrough, and a gap between the outer cylinder 130 and the rotor 111 is about 1 mm. As a result, both a magnetic gap and electric resistance of the rotor 111 can be reduced, and pump efficiency can be improved.

Further, a fluid loss of the rotating body such as a rotor 111 is proportional to the 2.5th power of a peripheral speed of the rotating body and 1st power of a length. The loss is generated on the inner surface and the outer surface of the rotor according to the first embodiment, but in the present embodiment, the fluid loss is generated only on the outer surface.

Moreover, a diameter of the stanchion 180 is decreased so that the fluid loss in this portion can be reduced.

In addition, in the present invention, since the rotor 111 stands, the weight is not applied to the outer cylinder 130. Moreover, since the value S is maximum at the start of actuating, the repulsion force between the stator 116 and the rotor 111 becomes maximum. As a result, when a small gap is allowed to be generated therebetween, a liquid enters this, and a great liquid film effect is generated as the rotation becomes faster so that contact and abrasion between the stator 116 and the rotor 111 are prevented.

In addition, when reversing braking is applied at the time of stopping and the power is turned off just after the rotor 111 is stopped, the repulsion force at the time of stopping becomes maximum, and the rotor 111 can be prevented by inertia from contacting with the outer cylinder 130.

However, when the rotor 111 is not parallel with the outer cylinder 130, the liquid film effect is decreased. Moreover, the impeller 112 receives a force towards a discharge port 125 and a force which crosses perpendicularly to this force even at the time of normal operation. Further, when a flow rate changes abruptly and a discharge amount is strangely out of a regular range, the operation of the impeller 112 itself becomes unstable, namely, vibrates. Further, if the pump is idled without a liquid, a speed of rotation of the rotor 111 rises abruptly, and the repulsion force is eliminated so that the liquid film effect is not generated. For this reason, the rotating portion occasionally contacts with a peripheral wall.

Therefore, in the present embodiment, the magnet mechanisms 182 and 183 are provided.

Figure 10:
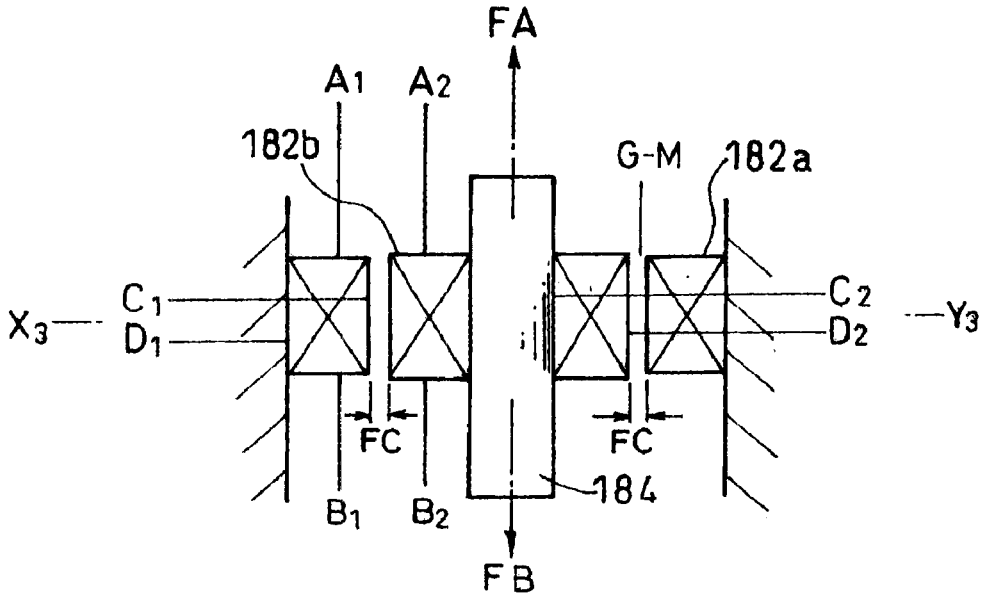
FIGS. 10 through 21 are explanatory diagrams of various magnet mechanisms to be used for the pump according to the second embodiment.
Figure 11:
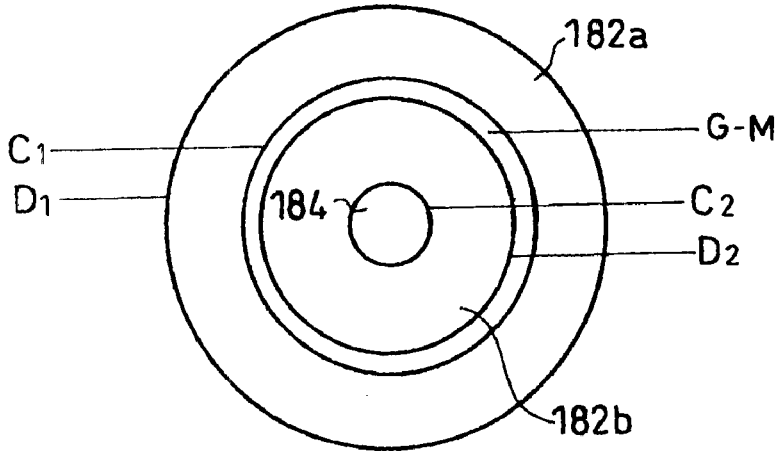

As for the upper magnet mechanism 182, its prototype is shown in a longitudinal section of FIG. 10 and a cross section taken along line X3-Y3 in FIG. 11. In the drawings, the upper magnet mechanism 182 includes a hollow cylindrical magnet 182*a* which is hung from the cover section 131 and a hollow cylindrical magnet 182*b* which stands on the top shaft 184 of the rotor 111. The same poles of the hollow cylindrical magnet 182*a* and the hollow cylindrical magnet 182*b* face each other so that a repulsion force is generated therebetween and the contact is avoided, and a shift of the rotating shaft position of the rotor 111 can be corrected.

However, as shown in FIG. 10 and 11, in the case where the hollow cylindrical magnet 182*b* is inserted into the hollow cylindrical magnet 182*a* with a gap G-M and upper end surfaces A1 and A2 have the same pole or opposed surfaces C1 and D2 have the same pole, when the magnet 182*a* is fixed, the magnet 182*b* moves towards FA or FB so as to be stabilized and its movement is unstable.

Figure 12:
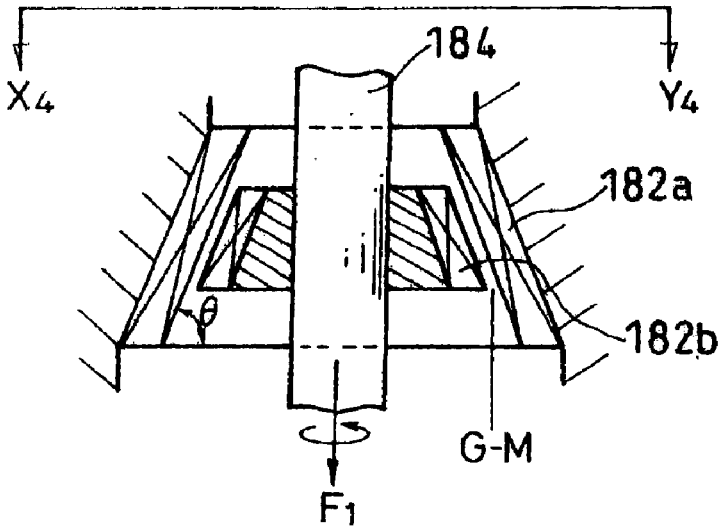
Figure 13:
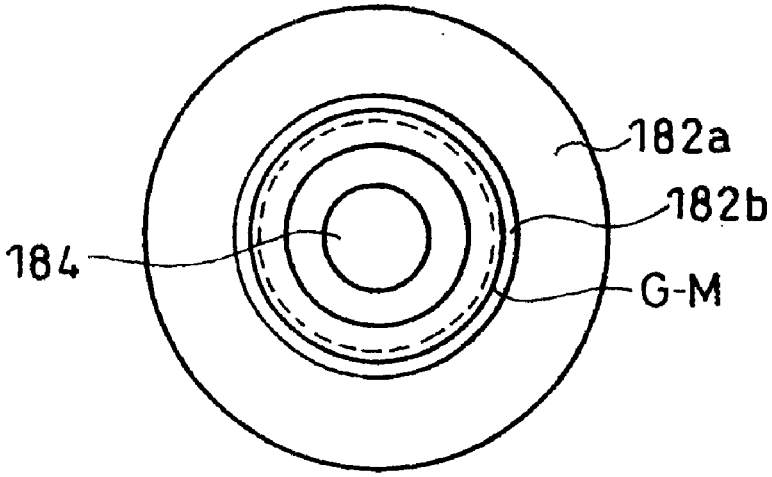

Therefore, it is preferable that the upper magnet mechanism 182 has the structure shown in FIG. 12 (longitudinal section) and FIG. 13 (fragmentary view taken along line X4-Y4).

In the drawings, the outer magnet 182*a* and the inner magnet 182*b* are conical and of similar hollow magnet cylinders. The inner magnet cylinder 182*b* is inserted into the outer magnet cylinder 182*a*, and their countered surfaces are parallel with a gap of 1 to 2 mm (G-M). Moreover, a tilt angle θ is 45 to 60°.

When upper and lower surfaces of the magnet cylinders 182*a* and 182*b* have the same pole or the countered surfaces have the same pole, a repulsion force always acts upon the countered surfaces of the inner and outer magnetic cylinders in the gap (G-M), and component of force F1 which directs downward is generated due to slant.

The outer magnet cylinder 182*a* is fixed and the inner magnet cylinder 182*b* is connected with the shaft 184 of the rotor 111, and a diameter of the gap (G-M) spreads downward. When the inner magnet 182*b* moves upward, the gap (G-M) becomes narrow abruptly, and the repulsion force increases abruptly so as to push back the inner magnet 182*b* downwardly. For this reason, a direction where the inner magnet cylinder is stabilized is a downward (F1) direction. The length of the inner magnet cylinder 182*b* is shorter than the length of the outer magnet cylinder 182*a* because when the inner magnet cylinder 182*b* moves, it prevents from departing from the outer magnet cylinder 182*a* and a decrease in the repulsion force is prevented. Moreover, when the polarities of the inner magnet cylinder 182*b* are formed by its inner and outer surfaces, it is preferable that its thickness is enlarged. This is for reducing an influence of a diamagnetic field function and reducing an influence of a suction force due to different poles of the inner and outer cylinders so as to prevent a decrease in the repulsion force.

Figure 14:
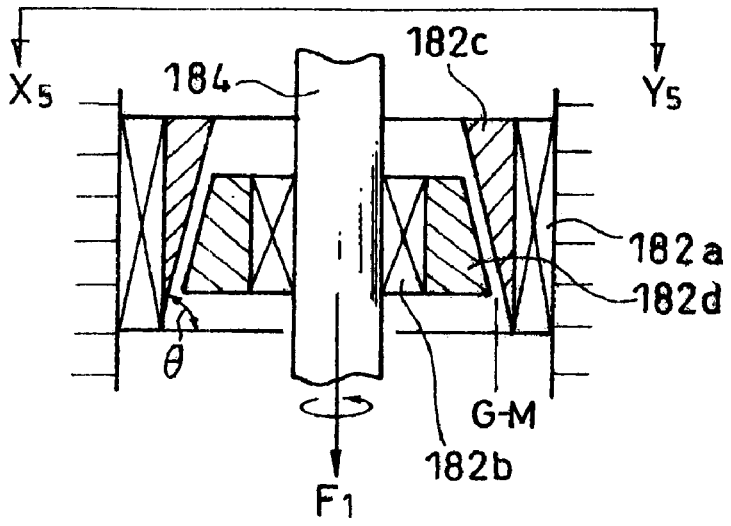
Figure 15:
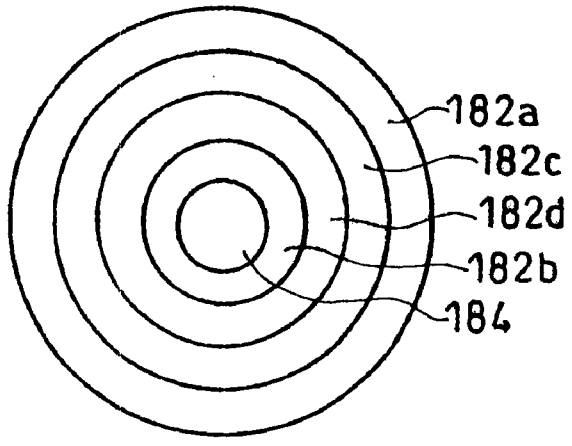

Next, there will be explained below another example of the upper magnet mechanism 182 with reference to FIG. 14 (longitudinal section) and FIG. 15 (fragmentary view taken along line X5-Y5).

The upper magnet mechanism 182 shown in the drawings is constituted so that an upright cylindrical magnet and a similar conical magnetic yoke are combined. The outer magnet cylinder 182*a* and the inner magnet cylinder 182*b* have an upright hollow cylindrical shape, and magnetic hollow cylindrical yokes 182*c* and 182*d* whose sections have wedge and similar conical shapes are attached to the inner surface of the outer magnet cylinder 182*a* and the outer surface of the inner magnet cylinder 182*b*. Countered surfaces of the hollow cylindrical yokes 182*c* and 182*d* are parallel with each other, and their gap (G-M) is 1 to 2 mm.

Polarities of the countered surfaces of the yokes 182*c* and 182*d* of the inner and outer magnet cylinders 182*a* and 182*b* are the same. As a result, a repulsion force always acts upon the countered sources of the yokes 182*c* and 182*d* in the gap (G-M) so that similarly to the above the stable center axis can be maintained.

Next, there will be explained below the lower magnet mechanism 183.

Figure 16:
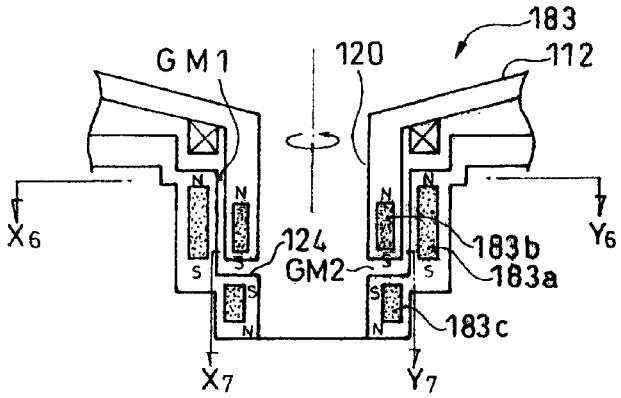
Figure 17:
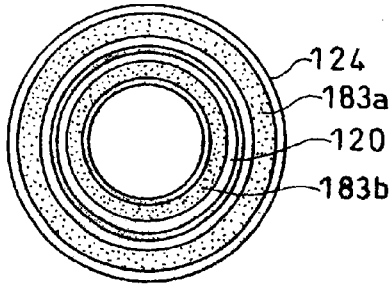
Figure 18:
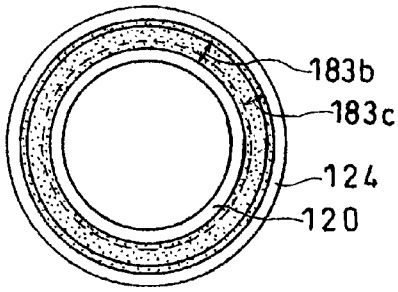

FIG. 16 is a longitudinal section of the lower magnet mechanism 183, FIG. 17 is a fragmentary view taken along line X6-Y6 in FIG. 16, and FIG. 18 is a fragmentary view taken along line X7-Y7 in FIG.16. The lower magnet mechanism 183 shown in the figures includes upright magnet cylinders 183*a*, 183*b* and 183*c* with different diameters. The inner magnet cylinder 183*b* is provided on an outer periphery of an intake passage 120 of the impeller 112, and the outer magnet cylinder 183*a* is provided on an inner periphery of the suction port 124 so as to face the inner magnet cylinder 183*b*, and the lower magnet cylinder 183*c* is provided on the inner periphery of the suction port 124 so as to face a lower end of the inner magnet cylinder 183*b*. The magnet cylinders 183*a* and 183*b* face each other with a gap (GM1). An inner periphery of the outer magnet cylinder 183*a* and an outer periphery of the inner magnet cylinder 183*b* have the same pole, and a lower surface of the inner magnet cylinder 183*b* and an upper surface of the lower magnet cylinder 183*c* have the same pole. The magnet cylinder 183*c* should have a large thickness. A gap (GM2)

between the magnet cylinders 183*a* and 183*b* is about 1 mm, and when a weight is applied to the inner magnet cylinder 183*b*, the end surface gap (GM2) between the inner magnet cylinder 183*b* and the lower magnet cylinder 183*c* is raised 2 to 3 mm by the repulsion force with the magnet cylinder 183*c*. With such a structure, a repulsion force always acts upon in the gaps (GM1) and (GM2), and the inner magnet cylinder 183*b* moves upward (F2) so as to be stabilized.

At this time, when a center line of a magnet portion of the magnet cylinder 183*b* comes to a more inner side than a center line of a magnet portion of the magnet cylinder 183*c*, in the case where suitable vertical external force and rotation are applied to the inner magnet cylinder 183*b*, their relative positional relationship is stabilized.

Figure 19:
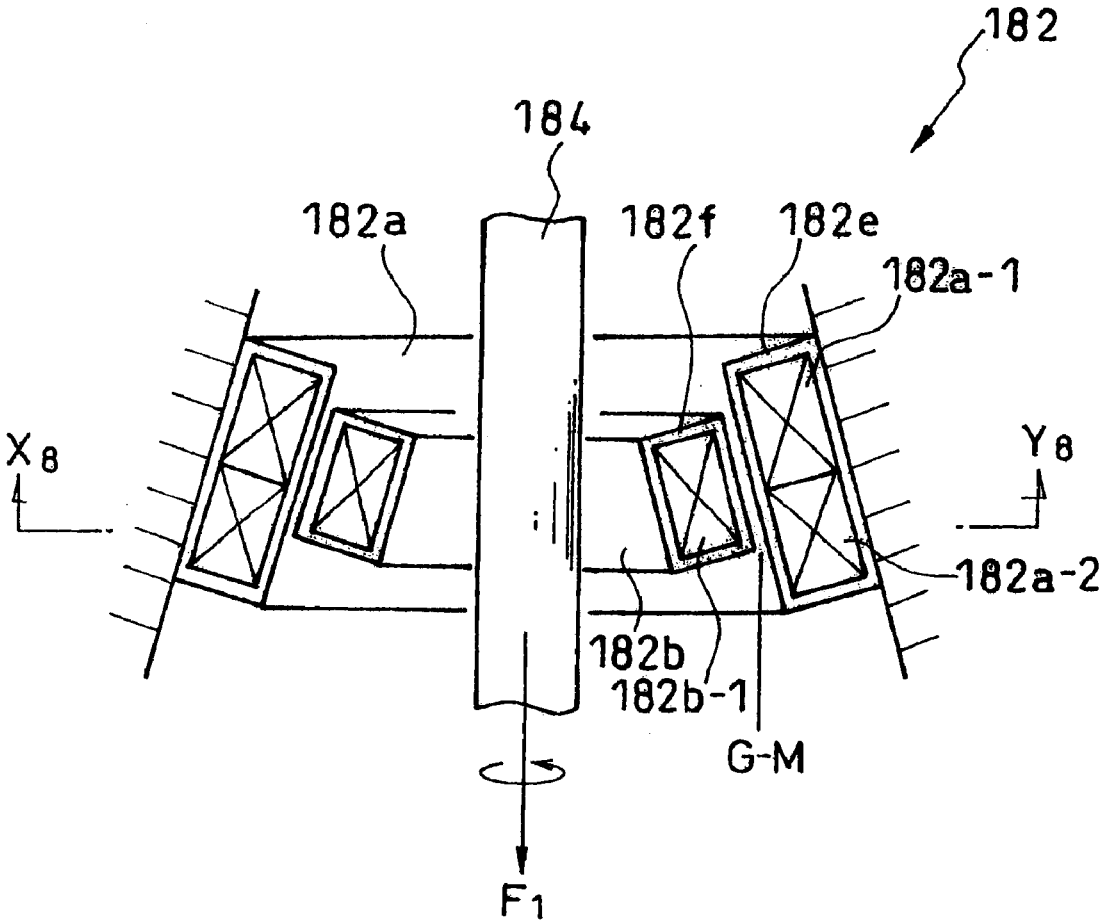
Figure 20:
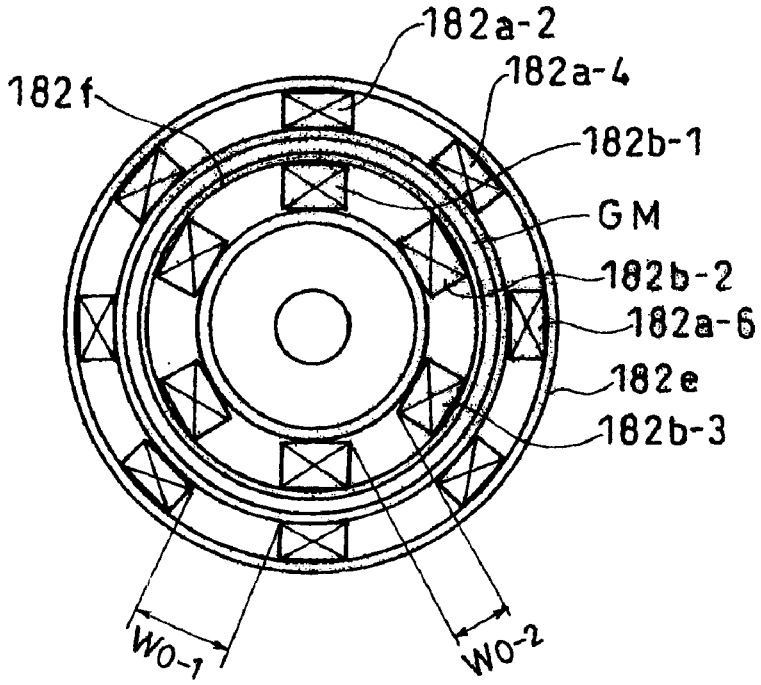
Figure 20:
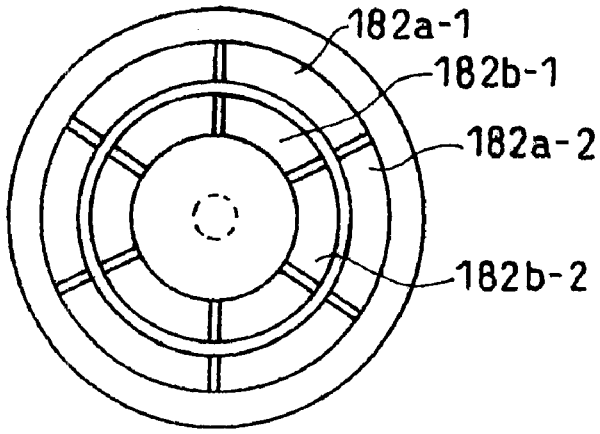

In the upper magnet mechanism and the lower magnet mechanism, rectangular parallelepiped magnets are arranged so that their polarities matches instead of the magnet cylinders, and thus they can be used as similar hollow magnet cylinders. FIG. 19 is a longitudinal section of the upper magnet mechanism 182 of one example, and FIG. 20(A) is a fragmentary view taken along line X8-Y8.

In the drawings, the rectangular parallelepiped magnets 182*a*-1, 182*a*-2 . . . are overlapped and they are surrounded by a cover 182*e* made of a non-magnetic material so that the outer magnet cylinder 182*a* is formed. Similarly, rectangular parallelepiped magnets 182*b*-1 are overlapped and are surrounded by a cover 182*f* so that the inner magnet cylinder 182*b* is formed. In this case, since gaps (W0-1) and (W0-2) between the arranged magnets are formed, the repulsion force between the inner and outer magnets is pulsated, but when a speed of rotation becomes high, the pulsation mostly disappears.

In addition, as shown in FIG. 20(B), it is preferable that the magnets 182*a*-1 . . . 182*b*-1 . . . are of circular arc shape.

Here, it is necessary that the upper magnet mechanism 182 and the inner magnet mechanism of the lower magnet mechanism 183 are stabilized in opposite directions.

Figure 21:
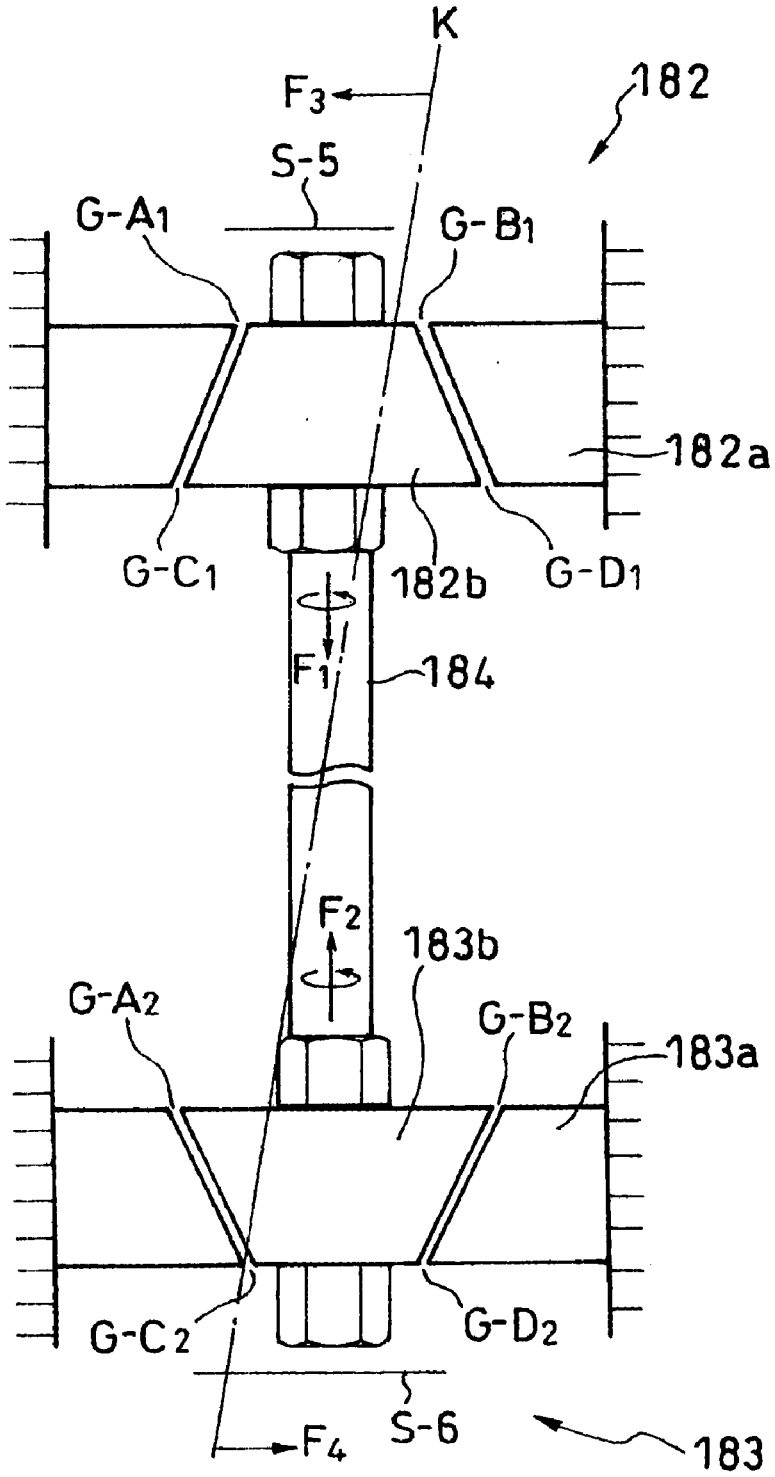

FIG. 21 shows a state that the upper magnet mechanism 182 and the lower magnet mechanism 183 are connected by the shaft 184. In this case, the upper magnet mechanism 182 generates a repulsion force in a direction F1 of pushing down the shaft 184, and the lower magnet mechanism 183 generates a repulsion force in a direction F2 of pushing up the shaft 184. The upper magnet mechanism 182 and the lower magnet mechanism 183 are adjusted so as to be in a parallel state while maintaining a constant gap between upper and lower surfaces (S-5) and (S-6) of the apparatus. If the shaft 184 slants as shown by a line K, gaps (G-B1), (G-B2), (G-C1) and (G-C2) become narrow, and their opposite portions become wide. For this reason, the repulsion forces in the respective gaps are different from each other, and as a result couple such as F3 and F4 is generated with respect to the line K so as to return the shaft 184 to its normal state.

In addition, in this pump, when the lower casing 114*a* at the lower part of the impeller 112 is removed, the impeller 112, the rotor 111, and inner magnets of upper and lower magnetic mechanisms can be easily taken out. For this reason, the inside can be cleaned extremely easily.

In addition, in the case where slurry or the like is mixed in the transfer liquid, the filter 146 is provided to a midway portion of the branch tube 148 from the discharge port and a clean liquid is poured into the rotor housing 128 so that the rotor 111 and the outer cylinder 130 can be prevented from abrading.

Further, since the stator 116 is soaked into the fire-resistant cooling and insulating oil 117, explosion-proofing of this portion is extremely high.

The items of the pump according to the present embodiment will be described below.

1. Stator 116
   AC220V, 60 Hz, 2P, 2.7 Kw, outer diameter: 160 mm ϕ, inner diameter: 83 mm ϕ, core layered thickness: 120 mm, F-type winding wire
2. Outer cylinder 130
   inner diameter: 82 mm ϕ, thickness: 0.5 mm, SUS304, a cover thickness: 3 mm
3. Rotor 116
   outer diameter: 80 mm ϕ, inner diameter: 54 mm ϕ, height: 130 mm, whole periphery coated with Teflon,
   outermost periphery 111*a*: copper cylinder with thicknesses of 1 and 2 mm (two types)
   magnetic cylinder 111*b*: SS400 and laminated electromagnetic steel plate (two kinds)
   conductor bar 111*c*: 28 copper bars of 4×4.5 mm end rings 111*d* and 111*e*: copper rings with outer diameter of 80 mm ϕ, inner diameter of 70 mm ϕ, and thickness of 10 mm
4. Transfer liquid tube 148
   outer diameter: 30 mm ϕ, SUS304 tube
5. Magnetic gap (g1)
   2.5 mm or 3.5 mm
6. Impeller 112
   material: rigid vinyl chloride, outer diameter: 148 mm ϕ, a number of blades: 6
7. Upper magnet mechanism 182
   samarium cobalt magnet of 8 mm (opening)×10 mm
   outer magnet: a number of attached magnets; 12 pieces
   inner magnet: a number of attached magnets; 6 pieces
8. Lower magnet mechanism 183
   outer magnet: a number of attached magnets 24 pieces
   inner magnet: a number of attached magnets 12 pieces
9. Outer casing 114
   SUS304 with fin and thickness of 3 mm
   lower casing 114*a*: thickness; 3 mm, SUS304, diameter of hose attached to intake port; 50 mm ϕ, diameter of hose attached to discharge port; 45 mm ϕ
10. Cradle 119
    Material: SS400
11. Insulating cooling oil 117
    silicone oil
12. Whole height of pump
    about 550 mm
13. Pump capacity
    input: 2.7 Kw,
    output: pump head; 15 to 20 mm
    discharge amount: 200 to 300 L/min
    a number of rotation of impeller: 2600 rpm
    efficiency: about 20 to 30%

Actual loading operation: after about 5-hour continuous operation, disassembly check is conducted. A trace of sliding of the rotating portion and the peripheral wall does not exist, namely, the test result is normal. The cooling oil is saturated at temperature of 60° C.

Slurry-mixed operation: SiC particles of about 50 μm is mixed. A discharge liquid is allowed to reflux through the filter. After about one-hour operation, disassembly is executed. The rotor and the outer cylinder hardly abrade.

Idling: after about 5-minute operation, disassembly check is conducted. There is no trace of sliding.

Figure 22:
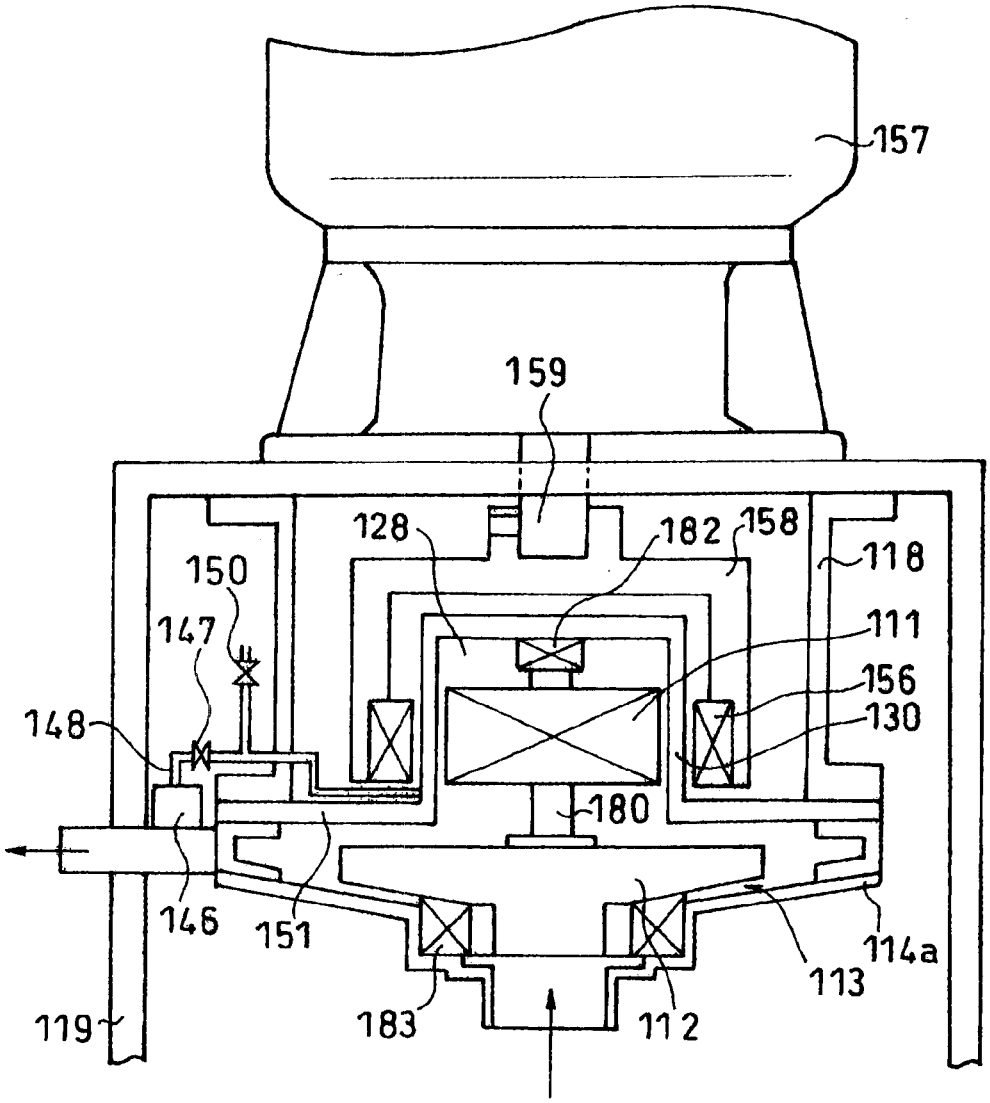
FIG. 22 is a cross section of the vertical pump according to a modified example of the second embodiment.

FIG. 22 shows a modified example of the pump according to the present embodiment, and the same reference numerals are given to portions corresponding to those in FIG. 7, and the description thereof is omitted.

The pump shown in FIG. 22 adopts a stator 156 having magnets driven to be rotated by a motor 157 as the rotation magnetic field generating means. For this reason, its electrical loss is not generated.

In addition, in the present embodiment, since a gap between the outer cylinder 130 and the rotor 111 is narrow, if slurry is mixed in the liquid, there is a possibility that the outer cylinder 130 and the rotor 111 abrade in this place.

Figure 23:
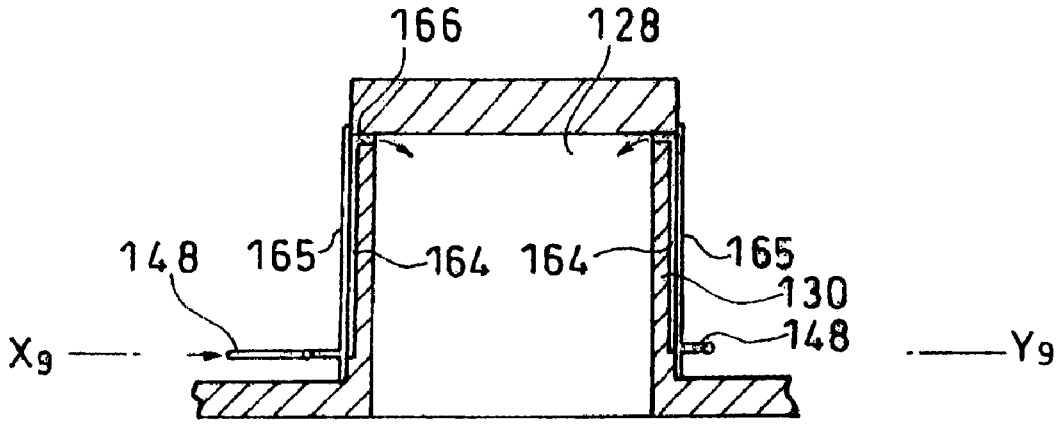
FIGS. 23 and 24 are explanatory diagrams of a liquid reflux mechanism into a rotor housing.
Figure 24:
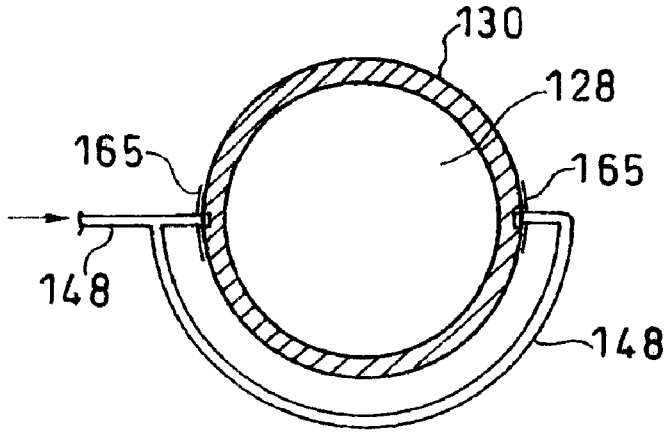

Therefore, in the present embodiment, the filter 146 and the transfer liquid tube 148 are provided from the discharge port, and the liquid from which the slurry was removed is allowed to reflux to the rotor housing 128. The detail of the reflux mechanism is shown in FIGS. 23 and 24.

In the drawings, a plurality of grooves 164 are provided outside the outer cylinder 130, and non-magnetic thin covers 165 are put over the grooves 164. The transfer liquid tube 148 is connected to the grooves 164, and the reflux liquid is supplied from an injection port 166 at the upper wall portion of the outer cylinder 130 into the outer cylinder 130.

Figure 25:
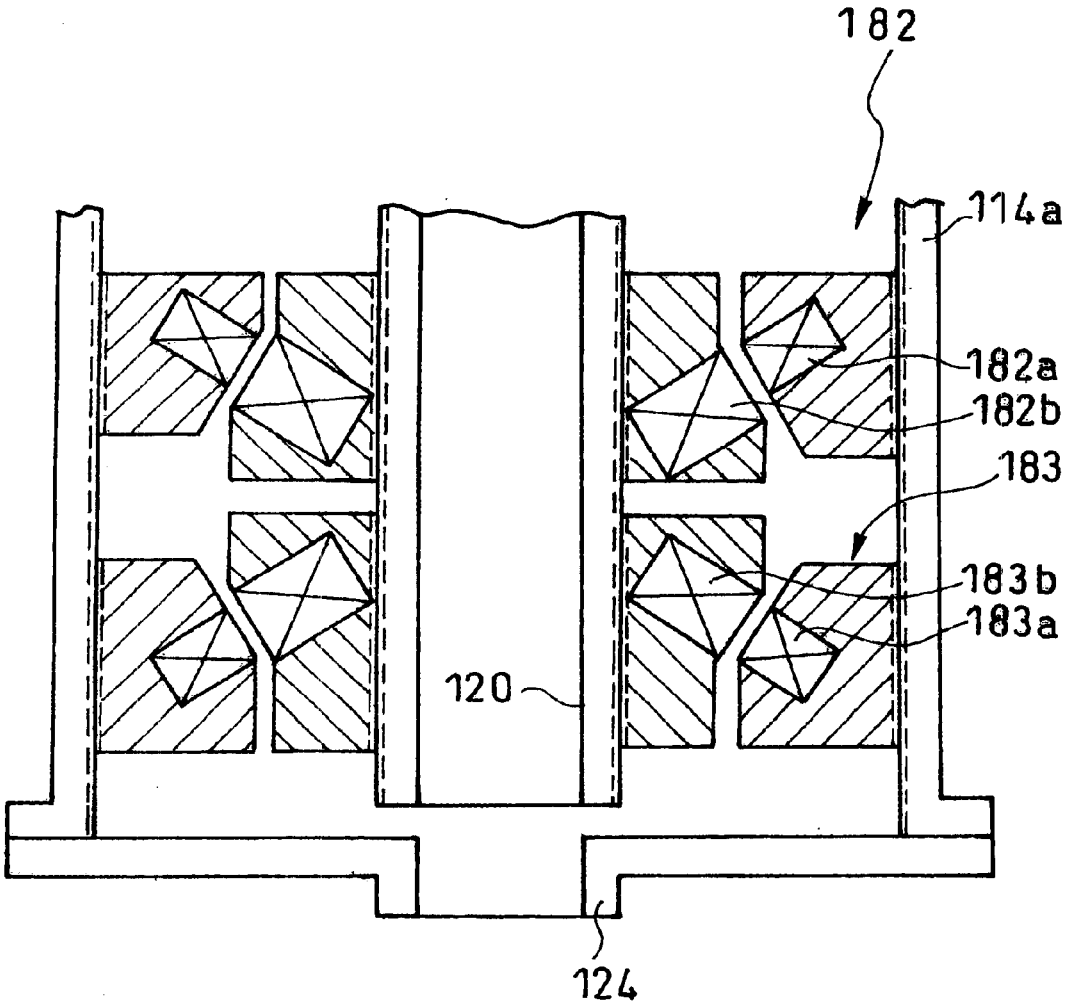
FIG. 25 is an explanatory diagram of one example of the magnet mechanism.

Here, it is suitable that the upper magnet mechanism 182 and the lower magnet mechanism 183 are, as shown in FIG. 25, provided so as to be adjacent to each other. The upper and lower magnet mechanisms 182 and 183 shown in the drawings can be provided on the impeller suction passage 124, for example. This is effective particularly in the case where the height of the rotating body 113 is limited.

The concrete items of the modified example will be described below.

1. Main body cover 160
   SUS304 with thickness of 3 mm
2. Lower casing 114*a*
   SUS304 with thickness of 3 mm
   diameter of hose attached to intake port: 50 mm ϕ
   diameter of hose attached to discharge port: 45 mm ϕ
3. Cradle 119
   material: SS400
4. Whole height of the pump
   about 550 mm
5. Rotation magnetic field generating magnetic cylinder 156
   samarium cobalt magnet, a number of polarities: 8
6. Outer cylinder 130
   resin with inner diameter of 110 mm ϕ, thickness of 3 mm, and cover thickness of 5 mm
7. Rotor 111
   outer diameter: 108 mm ϕ, inner diameter: 54 mm ϕ, height: 50 mm, whole periphery coated with Teflon
   outermost periphery 111*a*: copper cylinder with thickness of 1 and 2 mm (2 kinds)
   magnetic cylinder 111*b*: SS400 and laminated electromagnetic steel plate (2 kinds)
   conductor bar 111*c*: 14 copper bars of 4×6 mm
   end rings 111*d* and 111*e*: copper ring with outer diameter of 108 mm ϕ, inner diameter of 88 mm ϕ and thickness of 10 mm
   transfer liquid tube 148: SUS304 tube with outer diameter of 30 mm ϕ
   magnetic gap (g1): 2.5 mm or 3.5 mm
8. Impeller 112
   material: rigid vinyl chloride, outer diameter; 148 mm ϕ, a number of blades; 6
9. Upper magnet mechanism 182
   both inner and outer magnet cylinders; hollow conical plastic magnet (ferrite magnet)
10. Lower magnet mechanism 183
   outer magnet: combination of hollow cylinder and disc plastic magnets (ferrite magnet)
   inner magnet: hollow cylindrical plastic magnet (ferrite magnet)
11. Pump capacity
   motor: three-phase 220V, 2P, 60 Hz, input; 2.5 Kw,
   output: pump head 20 to 30 m
   discharge amount: 200 to 300 L/min
   a number of rotation of impeller: 2600 rpm
   efficiency: about 40 to 50%

Actual loading operation: after about 5-hour continuous operation, disassembly check is conducted. A trace of sliding of the rotating portion and the peripheral wall does not exist, namely, the test result is normal.

Slurry-mixed operation: SiC particles of about 50 μm are mixed. A discharge liquid is allowed to reflux through the filter. After about one-hour operation, disassembly is executed. The rotor and the outer cylinder hardly abrade.

Idling: after about 5-minute operation, disassembly check is conducted. There is no trace of sliding.

Third Embodiment

Figure 26:
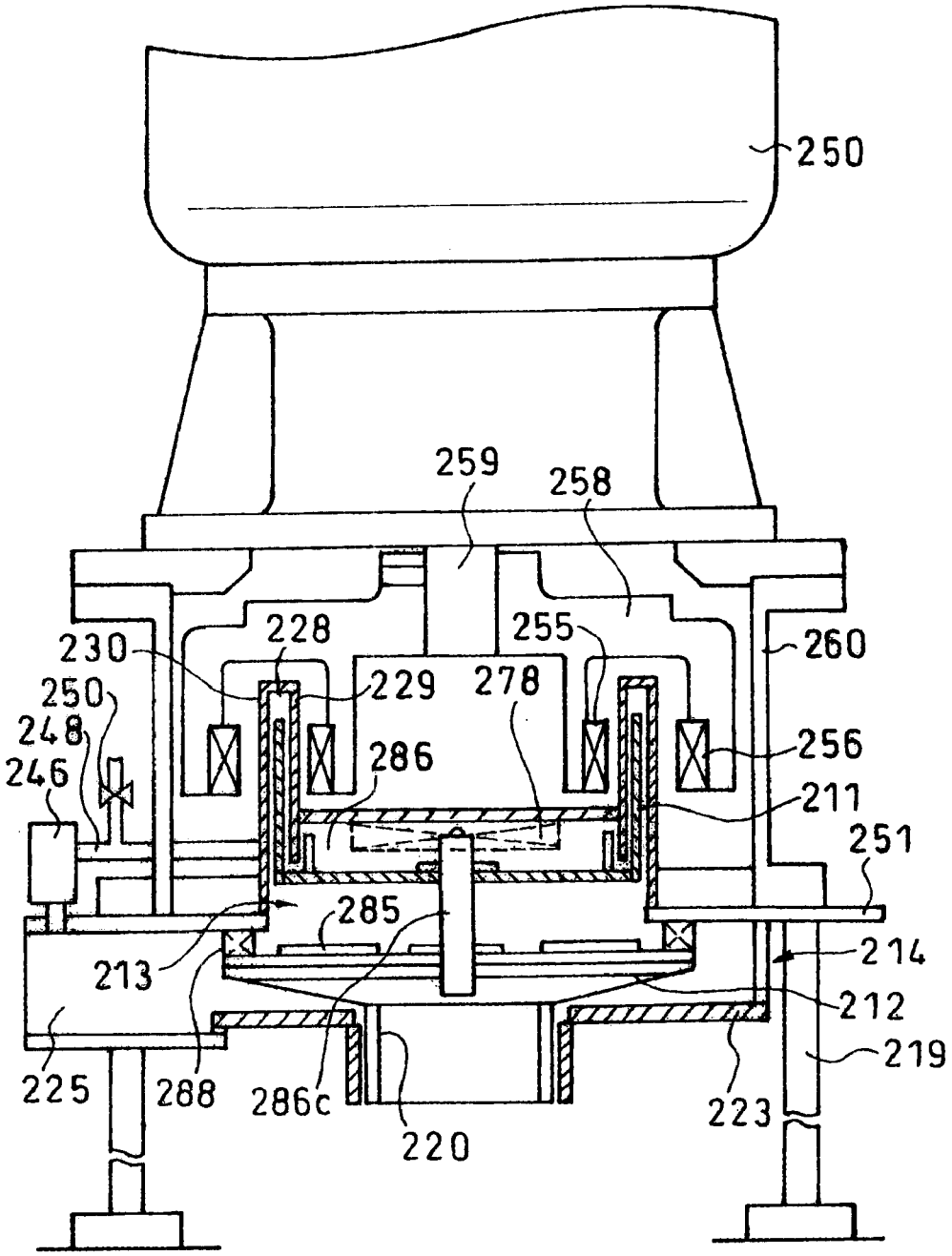
FIG. 26 is a cross section of the vertical pump according to a third embodiment of the present invention.

FIG. 26 shows a pump according to the third embodiment of the present invention. Reference numerals where 200 is added to the numerals in FIG. 4 are given to parts corresponding to those shown in FIG. 4, and the description thereof is omitted.

The characteristic of the present embodiment is that thrust adjusting means 285 is provided and further balancing means 286, a magnet mechanism 287 and equilibrium means 288 are provided.

Figure 27:
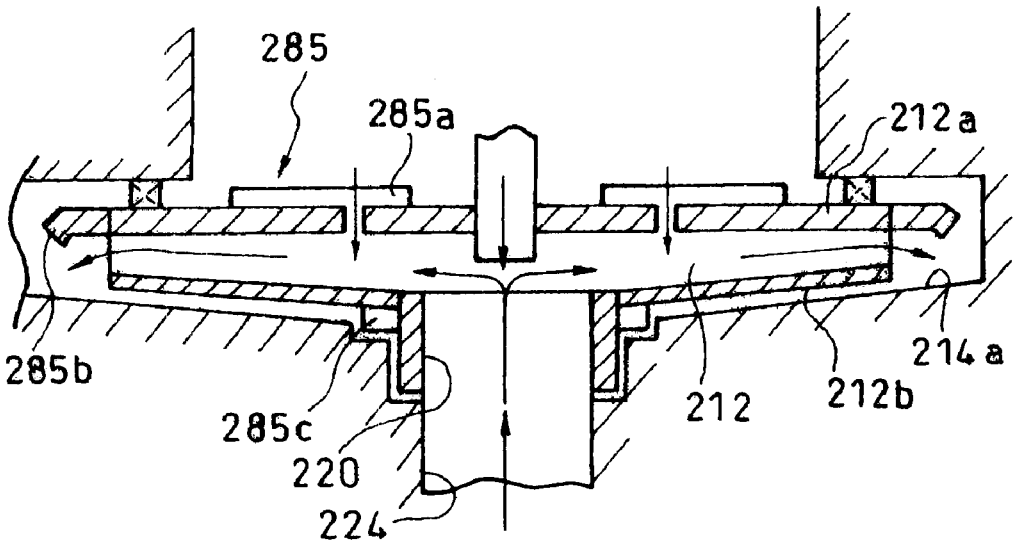
FIG. 27 is a detailed explanatory diagram of vicinity of an impeller of the pump according to the third embodiment of the present invention.

FIG. 27 shows a longitudinal section of an impeller 212. In the present embodiment, a plurality of discharge vanes 285*a* are provided as the thrust adjusting device 285 onto an upper surface of a main plate 212*a* of the impeller 212.

Namely, a pressure $F_1$ to be applied to the main plate 212*a* of the impeller is much greater than a pressure $F_2$ to be applied to a lower plate 212*b*. It is considered that this difference $F_1$–$F_2$ (thrust in lower axial direction) is approximately equal to (discharge pressure×cross section of impeller suction passage 220). A thrust bearing exists in a normal pump, but since a thrust bearing does not exist in this pump, in the present embodiment, the discharge vanes 285*a* are provided as a method of reducing the pressure $F_1$ so as to discharge fluid at the upper portion of the impeller 212. It is preferable that a height of the discharge vane 285*a* is about 5 mm. Moreover, an auxiliary edge 285*b* which has a narrow width and is slightly bent downward is provided on a whole periphery of the main plate 212*a* so that the discharge liquid bumps against this and a force directing upward is applied to the impeller 212. Meanwhile, when an auxiliary vane 285*c* is provided to a rear side of an impeller lower plate 212*b*, a liquid flows between the impeller lower plate 212*b* and an impeller casing 214*a*, and the pressure under the lower plate 212*b* and reflux liquid can be reduced against the flow of the liquid refluxing to the suction passage 220.

Next, there will be explained below the balancing device 286 adopted in the present embodiment with reference to FIGS. 28 and 29.

Figure 28:
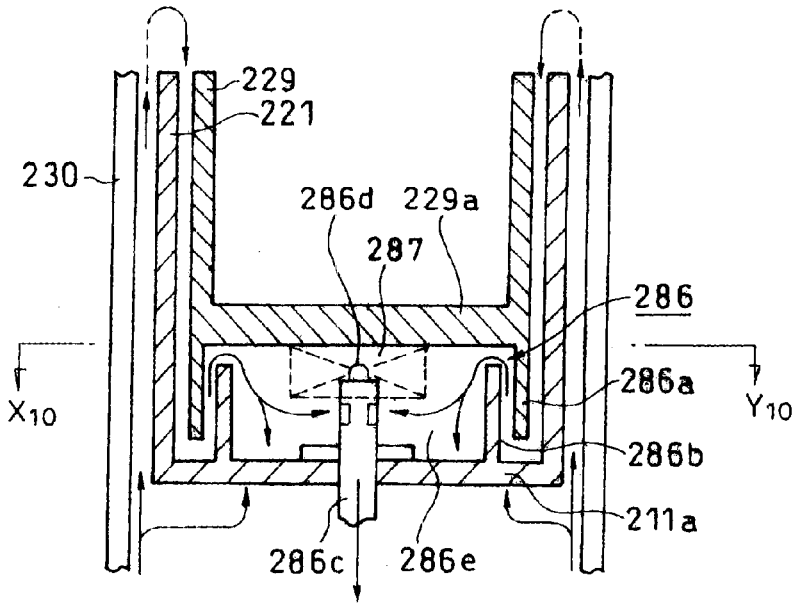
FIGS. 28 and 29 are explanatory diagrams of a balancing mechanism.
Figure 29:
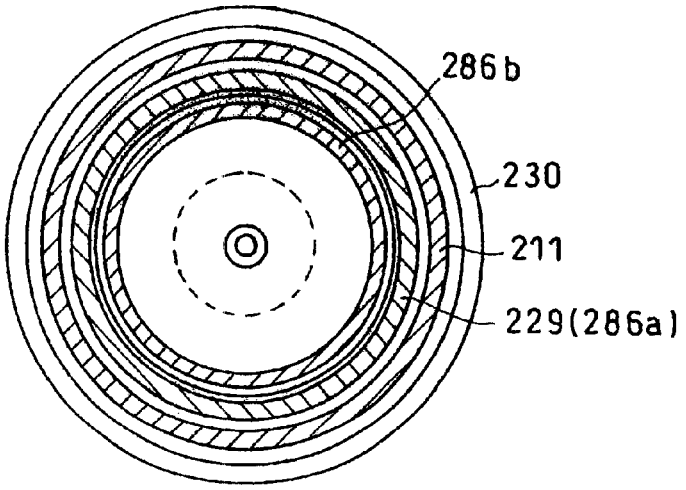

FIG. 28 shows an outline of the balancing device 286, and FIG. 29 is a cross section taken along line X10-Y10.

In the drawings, the balancing device 286 is composed of a rotor bottom plate 211*a*, an inner bottom plate 229*a*. An outer resistance cylinder 286*a* having an outer diameter approximately equal with an outer diameter of the inner bottom plate 229*a* is provided on a bottom surface of.the inner bottom plate 229*a*. An inner resistance cylinder 286*b*, which has a smaller outer diameter than that of the outer resistance cylinder 286*a* and can form a gap, is provided to the rotor bottom plate 211*a* correspondingly to the outer resistance cylinder 286*a*. The rotor bottom plate 211*a* is used as a balancing plate, and a hollow reflux pipe 286*c* which pierces through the center of the rotor bottom plate 211*a* is provided so as to be projected from the gap between the rotor bottom plate 211*a* and the inner bottom plate 229*a*. A forward end of the reflux pipe 286*c* is a hemispheric convex section 286*d*, and when the impeller 212 rises too high so as to possibly contact with the upper peripheral wall, the convex section 286*d* is brought into contact with the inner bottom plate 229*a* so as to prevent a damage to the impeller 212 or the like.

A part of a discharged liquid with high pressure, which enters the upper surface of the impeller 212 via the transfer liquid tube 248, pressurizes a lower surface of the balancing plate 211*a*, and passes a gap among an outer cylinder 230, an rotor 211, an inner cylinder 229, and a gap between the inner and outer resistance cylinders 286*a* and 286*b* to enter the balancing device 286 and passes the reflux pipe 286*c* to reflux to a center portion of the impeller 212. Since the discharged liquid passes the narrow gaps up to an inside space 286*e*, the liquid receives considerable flow loss and its pressure is lowered so as to be approximated to an inner pressure of the impeller 212.

When pressure of the lower surface of the balancing plate 211*a* is P and pressure of the inner surface is $P_0$, $[(P-P_0)\times$ area of balancing plate] becomes a force which pushes up the balancing plate 211*a*. When this force is equal with or larger than a force [discharge pressure of the impeller 212×cross section of suction passage], the forces to be applied to the upper and lower surfaces of the impeller can be canceled.

Next, there will be explained below the magnet mechanism 287 with reference to FIG. 30(A).

In the present embodiment, the magnet mechanism 287 includes a donut-shaped magnet 287*a* arranged on the lower surface of the inner bottom plate 229*a* (center point $O_1$, center line $\phi$1), and a donut-shaped magnet 287*b* arranged on the upper portion of the reflux pipe 286*c* (center point $O_2$, center line $\phi$2). Countered surfaces of the magnets 287*a* and 287*b* in the regular state have different polarities.

f is an external force directing to a vertical direction, F is a force that $O_1$ tries to move to $O_2$, and F1 is a component of force of F towards the vertical direction. When the external force f to be applied to the reflux pipe 286*c* (rotational axis) directs only to the vertical direction and motion to the up-and-down direction is limited but movement to the back-and-forth and right-and-left directions is not restrained, a rotational axis 286*c* moves so that $\phi$1 and $\phi$2 coincide with each other by a component of force of F to the horizontal direction (F2). Thereafter, when f is decreased and $F_1>f$, $O_1$ and $O_2$ coincide with each other coaxially. When the hemispherical convex section 286*d* is brought into contact with the forward end of the rotational axis 286*c*, the rotational axis 286*c* contacts with the inner bottom plate 229*a* at the convex section 286*d* so as to be stopped.

Figure 30:
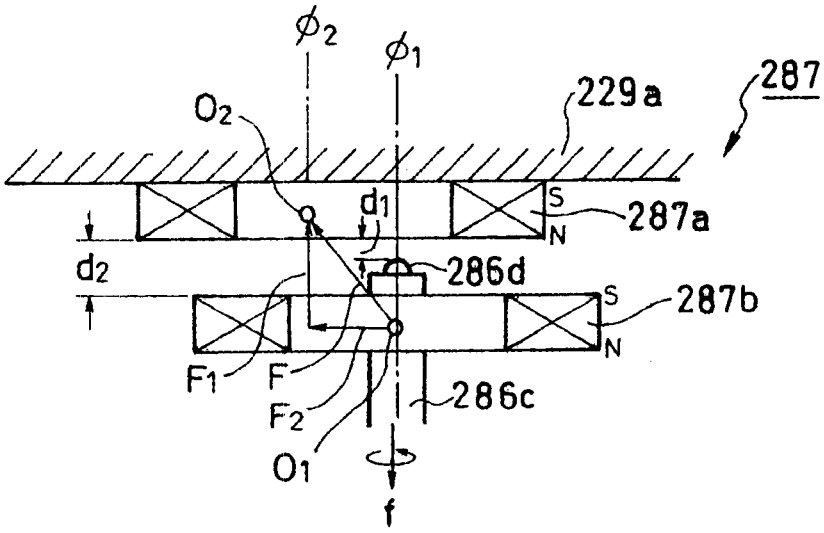
FIGS. 30(A) and 30(B) are an explanatory diagram of one example of the magnet mechanism.
Figure 30:
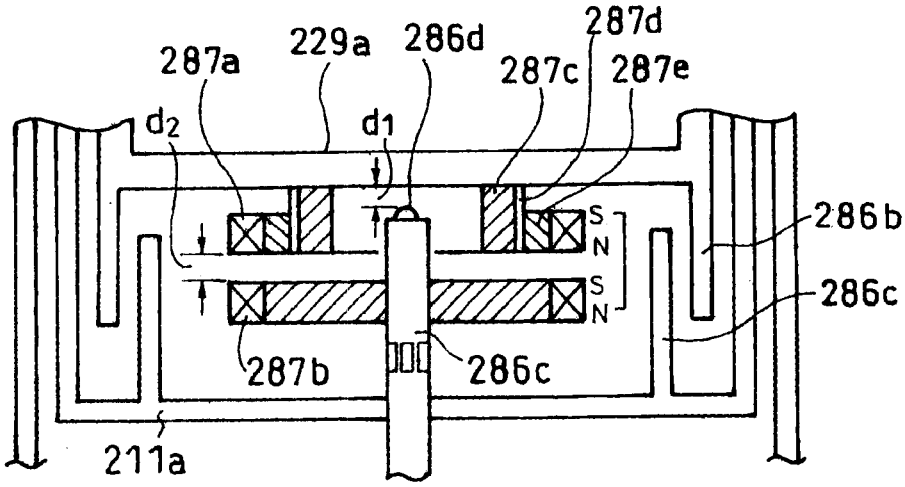

The above magnet mechanism 287 is attached into the balancing device 286. This state is shown in FIG. 30 (B).

In FIG. 30(B), a cylinder 287*c* is attached to the inner bottom plate 229*a*, and a thread 287*d* is formed on the outside of the cylinder 287*c*. The donut-shaped magnet 287*a* is fixed to a cylinder 287*e* formed with a thread on its inner periphery, and the cylinder 287*e* is threaded into the cylinder 287*c*. A gap $d_2$ between the donut-shaped magnet 287*b* and the donut-shaped magnet 287*a* fixed to the reflux pipe 286*c* is adjusted by the threaded state of the cylinder 287*e*.

When the impeller 212 is stopped, a thrust force directing downward and a force directing upward due to the balancing device 286 which are applied to the impeller 212 are canceled. Therefore, the strength of the magnets and the weight of the rotating body 213 are adjusted so that suction forces due to both the magnets 287*a* and 287*b* pull up the weight of the rotating portion even in the gap ($d_2$). As a result, at the time of stopping, the forward end of the hemispherical convex section 286*d* contacts with the inner bottom plate 229, and at the time of operation, the thrust force works so as to release the contact. Since the weight of the rotating body 213 is about 2 kg in the case of 2.2 Kw pump, selection of the magnets is easy.

Next, there will be explained below the equilibrium device 288 with reference to FIG. 31.

Figure 31:
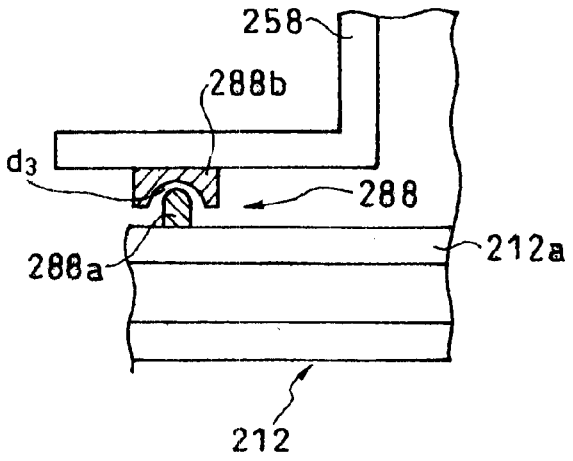
FIG. 31 is an explanatory diagram of an equilibrium mechanism.

As is clear from FIG. 31, the equilibrium device 288 is provided to an upper peripheral edge of the impeller main plate 212*a*, and has a hollow cylindrical convex section 288*a* whose outer diameter is substantially equivalent to the impeller 212 , and a cylindrical groove 288*b* which is provided on the bottom plate 251 and faces the low hollow cylindrical convex section 288*a*.

The cylindrical convex section 288*a* and the groove 288*b* are arranged with a gap $d_3$. At the time of normal driving, a discharged liquid from the impeller 212 through the gap $d_3$ enters a space at the upper surface of the impeller, and pressurizes the impeller main plate 212*a* and the balancing plate 211*a*. However, since this liquid is refluxed through the reflux pipe 286*c*, when a inflow into the inner space 286*e* is decreased, the liquid pressure at this portion is also decreased, and a difference in pressure to be applied to the upper and lower surfaces of the balancing plate 211*a* is decreased and the force which pushes up the rotating section is also decreased.

In the case where the force which pushes up the rotating portion is too strong at the time of operation so that the convex section 286*d* at the forward end of the reflux pipe 286*c* contacts with the inner bottom surface 238*a*, $d_3$ becomes narrow, the inflow into the space 286*e* is decreased and the pushing-up force is decreased. As a result, the pressure difference between the upper and lower surfaces of the balancing plate 211*a* and the thrust force to the impeller 212 are decreased, and the impeller 212 rotates in a balanced position.

In any cases, $d_2<d_3$, but the value of $d_3$ is selected so that the difference ($d_3$-$d_2$) can cope with the pressure.

Next, there will be explained below a radial force to be applied to the impeller 212 in the present embodiment.

A radial thrust $T\gamma$ of the impeller 212 is proportional to $[1-(Q/Q_n)^2]$.

Here, $Q_n$ is a regular discharge amount, and Q is an actual discharge amount.

For this reason, in general, when the discharge valve is closed, Q becomes zero, and $T\gamma$ becomes maximum.

Therefore, in order to eliminate deflection due to the radial thrust and prevent sliding between the rotating body and the peripheral wall, for example, it is suitable that the discharge valve and the intake valve are interlocked mechanically or electrically so that $Q/Q_n$ is maintained approximately 1, or a speed of rotation of the motor is changed by opening of the discharge valve or a signal of a flow meter so that $Q_n$ is adjusted.

Figure 32:
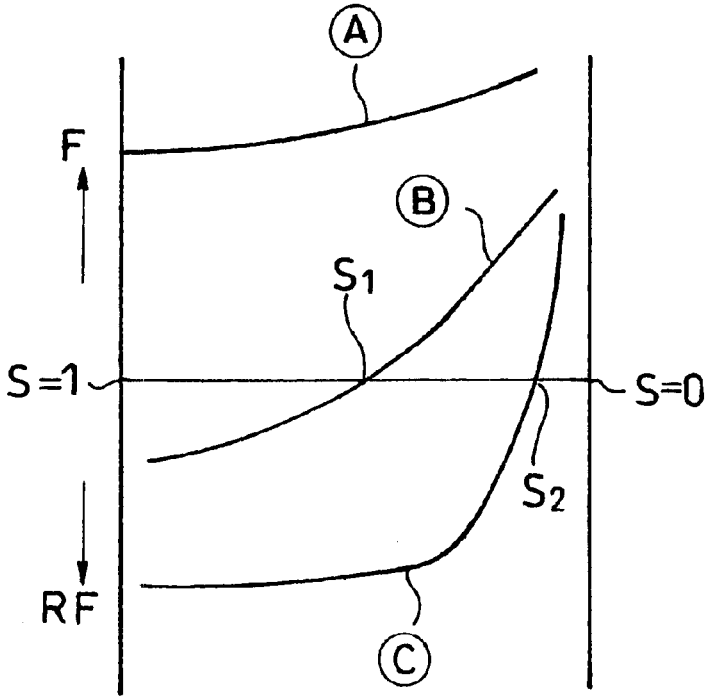
FIG. 32 is an explanatory diagram showing an electromagnetic repulsion force between a non-magnetic cylinder and a rotation magnetic field mechanism.

FIG. 32 is a graph showing an electromagnetic repulsion force between the non-magnetic cylinder and the rotation magnetic field device. As for a motion of the non-magnetic body in the rotation magnetic field (or proceed magnetic field), when a product of a magnetic Reynolds number (Rm) and SLIP (S) in a structure of the rotation magnetic field and the conductor becomes Rm·S >1, the conductor receives a repulsion force (RF) from the rotation magnetic field, and when Rm·S<1, the conductor receives a suction force (F). When the pump is driven, S=1, and the repulsion force is maximum (about 150%). When a gap is generated between the rotor 211 and the rotor housing 228 by the repulsion force and a liquid enters there, an wedge effect due to a liquid film is increased by the rotation of the rotor 212.

The concrete items of the modified example will be described below.

1. Outer cylinder 230
   resin cylinder with thickness of about 4 mm, a groove with depth of about 0.5 mm is provided to an outside of the cylinder, and covered with SUS304 with thickness of 0.5 mm
2. Inner cylinder 229
   resin cylinder with thickness of about 3 mm, bottom thickness: about 5 mm
3. Magnet of the outer magnet cylinder 256
   8 male screw magnets
4. Magnet of the inner magnet cylinder 255
   8 male screw magnets
5. Rotor 211
   aluminum cylinder with thickness of 3 mm, inside and outside coated with glass, bottom composing the balancing plate
6. Magnetic gap
   about 17 mm
7. Impeller 212
   material: acrylic resin, outer diameter: 148 mm ϕ, mounting of balancing device containing magnet mechanism
8. Driving motor
   AC220V, 3-phase 2P, 2.2 Kw, inverter control
9. Pump ability
   motor: 3-phase 220V, 2P, input; 2.2 Kw, inverter control
   output: pump head; about 30 m
   discharge amount: 250 l/min
   efficiency: about 50%

As a result of the test, fluid loss of the rotor is generated approximately in proportion to 2.5th power of the outer peripheral speed and 1st power of the length. Meanwhile, the repulsion force and the rotational force which the rotor receives from a primary side are substantially proportional to a corresponding area. For this reason, a primary inner diameter is small and a length is long. Therefore, it was found that when the inner diameter and the length of the rotor are also set in such a manner, the efficiency is high.

Fourth Embodiment

Figure 33:
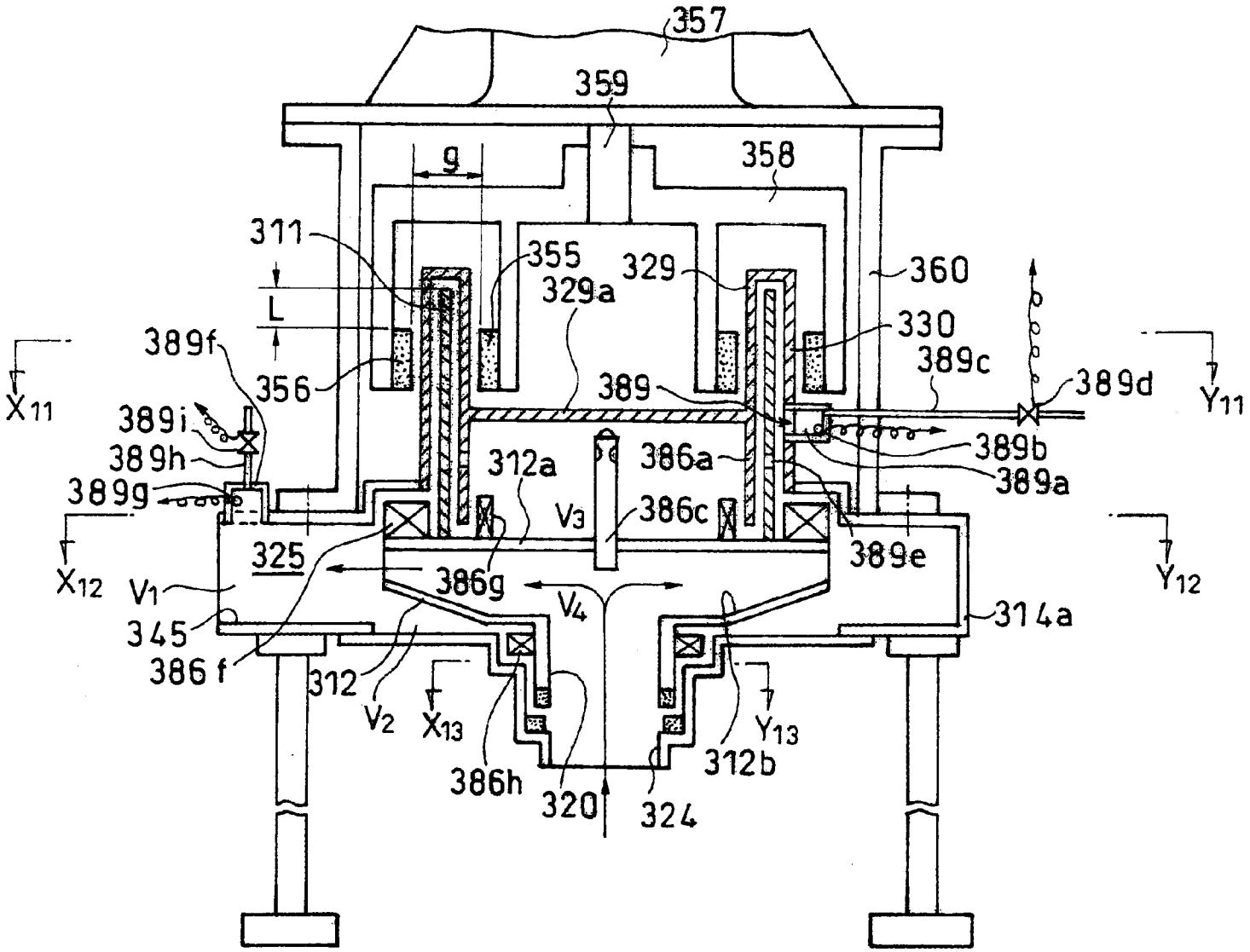
FIG. 33 is a cross section of the vertical pump according to a fourth embodiment of the present invention.
Figure 34:
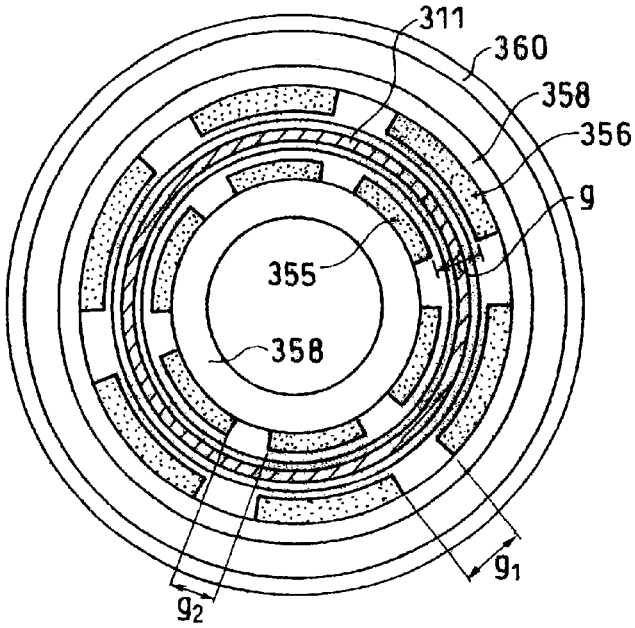
FIGS. 34 through 36 are explanatory diagrams of an aileron mechanism to be suitably used in the fourth embodiment.
Figure 35:
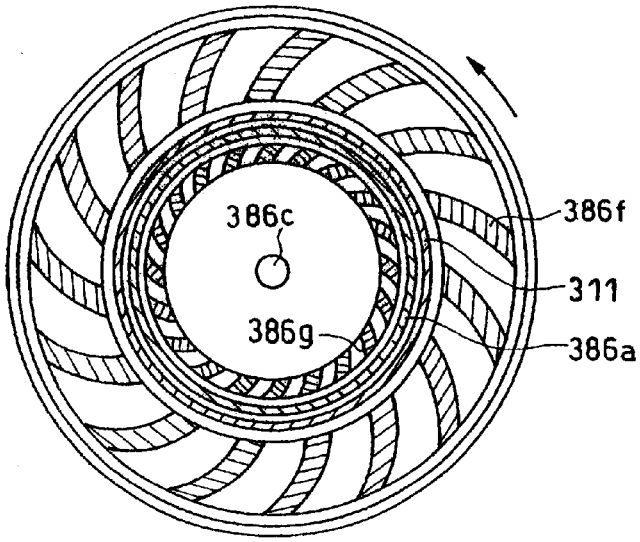
Figure 36:
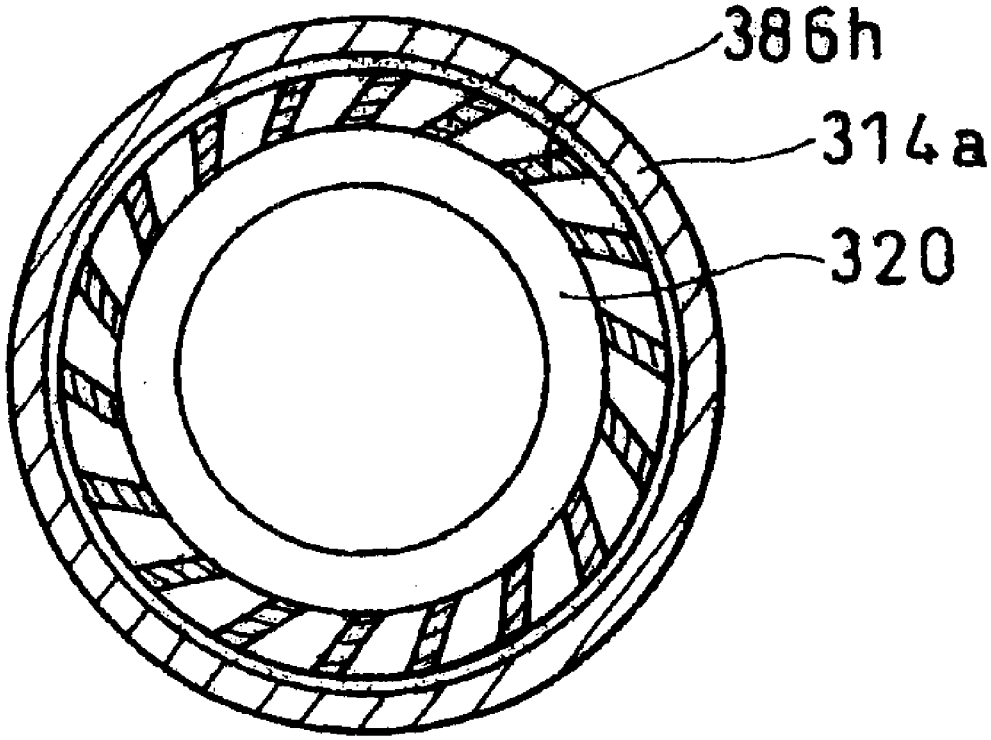

There will be explained below the fourth embodiment of the present invention with reference to FIG. 33. Here, FIGS. 34, 35 and 36 are cross sections taken along lines $X_{11}$-$Y_{11}$, $X_{12}$-$Y_{12}$ and $X_{13}$-$Y_{13}$. Moreover, reference numerals where 300 is added to the numerals in the first embodiment are given to parts corresponding to those in the first embodiment, and the description thereof is omitted.

In the present embodiment, a lower end outside of an outer cylinder 330 is connected to an impeller casing section 314*a* by a flange. Moreover, a lower section of an inner cylinder 329 is extended to a lower direction of an inner bottom plate 329*a* so as to form an outer resistance cylinder 386*a*. A hollow cylindrical rotor 311 with suitable thickness (3 to 4 mm) as a non-magnetic electric good conductor is arranged in a gap between the inner and outer cylinders, and this rotor 311 is rotatable freely in the gap. The gap between the rotor 311 and the outer and inner cylinders is about 1 mm, and a lower end of the rotor is fixed to an impeller main plate 312*a*. Here, its liquid contact portion is coated with anti-corrosion and anti-wear material as the need arises.

As mentioned above, when the cylinder is rotated in a liquid, the liquid loss is substantially proportional to a product of 2.5th power of a peripheral edge speed and a length (height) of the cylinder. Since the rotor of this pump is rotated in a liquid, this loss cannot be ignored. Particularly in the case where viscosity of a transfer liquid is high, the loss is large. Meanwhile, since an area surface of the rotor influences generation of the rotational force, when a rotor diameter is set to be small, it is necessary to enlarge its length.

Therefore, when the liquid contact portion of the rotor is decreased and a portion which contacts with a gas with extremely low viscosity, for example, an air is enlarged, a generated torque of the rotor is hardly influenced and the fluid loss can be reduced.

In the present embodiment, a rotor resistance reducing mechanism 389 has a small air receiver 389*a* which is obtained in such a manner a hole is provided to the outer cylinder 330 corresponding to a center position of the rotor 311 and the air receiver is provided in the hole. A detection end 389*b* of a fluid detector is provided in the air receiver 389*a*. A pipe 389*c* is taken out from the air receiver 389*a* so as to be connected to a compressed air source via an on-off valve 389*d*. A plurality of holes with suitable size (rotor inflow holes) 389*e* are formed around the rotor 311 in a position lower than the air receiver 389*a*, a liquid entered from the side of the outer cylinder 330 flows from the rotor inflow holes 389*e* into an inside of the rotor 311, and this liquid compresses the air in the rotor housing 328 upward so that the upper portion of the rotor 311 is replaced by a contact portion with the air. In order to adjust a length of the air contact portion, an injection amount of the compressed air is adjusted. In the case where the fluid loss is small because the outer diameter and height of the rotor 311 is small in the small-capacity pump, or in the case where the viscosity of the liquid is low, such a reducing mechanism 389 is not required, but in the case where the pump capacity is large or in the case where the viscosity of the transfer liquid is high, it functions extremely effectively.

Here, in the present embodiment, since the air is supplied into the rotor housing 328, there is a possibility that air bubbles are mixed in the discharged liquid.

For this reason, an air trap 389*f* is provided in a pipe arrangement 345 of the discharged liquid, and a liquid detector 389*g* is provided in the air trap, and the air trap 389*f* is connected with a discharge pipe 389*h* so that the air in the air trap 389*f* is suitably discharged by operation of an on-off valve 389*i*. The on-off valve 389*i* can be controlled by a signal of the detector 389*g*.

In addition, a pressure $F_1$ directing downward is applied to the impeller main plate 312*a*, and in the present embodiment the outer resistance cylinder 386*a* is provided to the inner bottom plate 329*a* so as to reduce the pressure F1. A first aileron 386*f* is provided on a peripheral edge of the impeller main plate 312*a*, and a second aileron 386*g* is provided on a side slightly more inward than the outer resistance cylinder 386*a*. As shown in FIG. 35, the ailerons 386*f* and 386*g* work such as pushing the inside liquid out at the time of rotation. However, since pressure of an outside $V_1$ portion is high, the liquid enters inside against the function of the ailerons 386*f* and 386*g*, but its fluid resistance is extremely high, and an inflow is limited and the pressure is lowered. The liquid which entered a $V_3$ portion flows into the impeller 312 via a reflux pipe 386*c* which stands on a center of the impeller 312. Normally, pressure $P_3$ of the $V_3$ portion is higher than pressure $P_4$ at the center portion of the impeller. Due to this flow, the pressure $P_3$ of the $V_3$ portion becomes fairly lower than the pressure $P_1$ of the $V_1$ portion.

In addition, in the present embodiment, it is necessary not to lower pressure of the gap ($V_2$) between the impeller 312*b* and the impeller casing section 314*a*. Namely, at the time of driving, the impeller 312 should not contact with the impeller casing section 314*a*, but the liquid on the discharge side is refluxed through the gap to a suction passage 320. When the reflux amount is large, the discharge pressure PI of the gap $V_1$ portion of a discharge port 325 and the pressure $P_2$ of the gap $V_2$ portion are lowered so that a force which pushes up the impeller 312 is decreased.

Therefore, a third aileron 386*h* is attached to the suction passage 320 of the impeller 312, and the liquid is pushed out from the inside. In this case, since the pressure $P_2$ of the gap $V_2$ portion is high, the liquid passes through the third aileron 386*h* and a narrow gap so as to be refluxed to a suction port 324, but since the fluid resistance is large, its amount is greatly limited. As a result, a discharge amount from the impeller 312 is maintained in a regular amount, and the pressure of the gap $V_2$ portion can be prevented from being lowered so that the force which pushes up the impeller 312 can be maintained.

Figure 37:
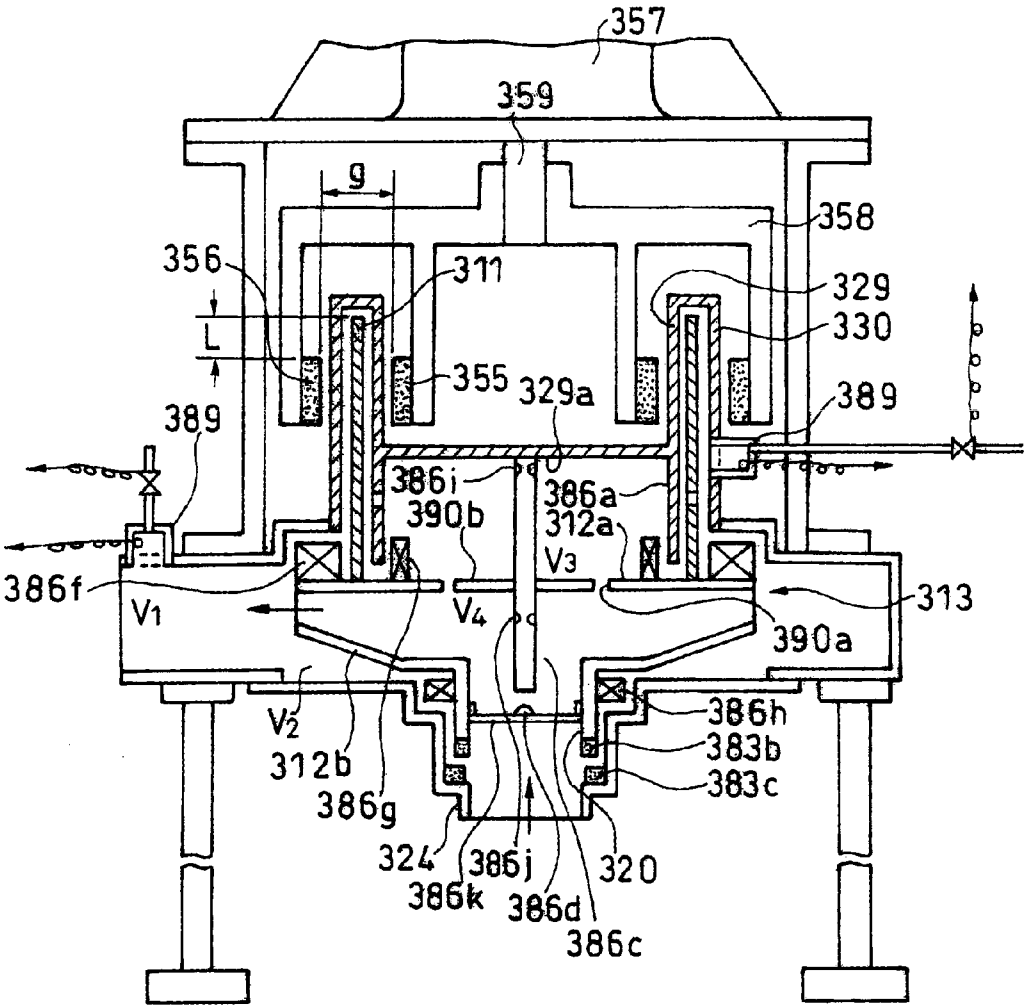
FIG. 37 is an explanatory diagram of a modified example of the fourth embodiment.

FIG. 37 shows a modified example of the present embodiment.

Namely, an area of the impeller main plate 312*a* is decreased so that a pressure to be applied to an upper surface of the impeller main plate 312*a* can be reduced. For this reason, in FIG. 37, a circular opening 390*a* (impeller center opening) with diameter D is provided at the center of the impeller main plate 312*a*.

It is suitable that the diameter D is the same as or slightly larger than the outer diameter of the impeller suction passage 320. A disc 390*b* (equalizer plate), which is hung from the inner bottom plate 329*a* and is supported to the reflux pipe 386*c*, is provided in the center opening 390*a*, and its outer diameter is set to be slightly smaller than the diameter D so as to form a gap d.

A lower end of the reflux pipe 386*c* pierces through the equalizer plate 390*b* so as to be extended to the inside of the impeller 312. A plurality of inflow holes 386*i* are provided around the upper end of the reflux pipe 386*c*, and a plurality of outlet ports 386*j* are provided inside the impeller 312.

As a result, since the equalizer plate 390b is connected with the inner bottom plate 329*a*, a pressure to be applied to the upper surface of the equalizer plate 390*b* does not becomes a force which pushes down the impeller 312. Therefore, when areas of the impeller main plate 312*a* and the impeller lower plate 312*b* are the substantially same, forces to be applied to the upper and lower surfaces of the impeller 312 are balanced, and since the pressure in the gap $V_3$ is decreased by the ailerons 386*f*, 386*g* and 386*h*, the impeller 312 obtains buoyancy.

Here, the liquid which flows into the space $V_3$ at the upper portion of the impeller 312 is refluxed into the impeller 312 via the inflow hole 386*i*, the reflux pipe 386*c* and the outlet hole 386*j*. Moreover, a supporting bar 386*k* is provided in the suction passage 320, and a hemispherical convex section 386*d* is provided at the center of the supporting bar 386*k* or the lower end of the reflux pipe 386*c* so as to prevent the impeller 312 from contacting with the peripheral wall when the impeller 312 rises.

Next, there will be explained below a magnet mechanism 383 of the present embodiment with reference to FIGS. 38 through 41.

Figure 38:
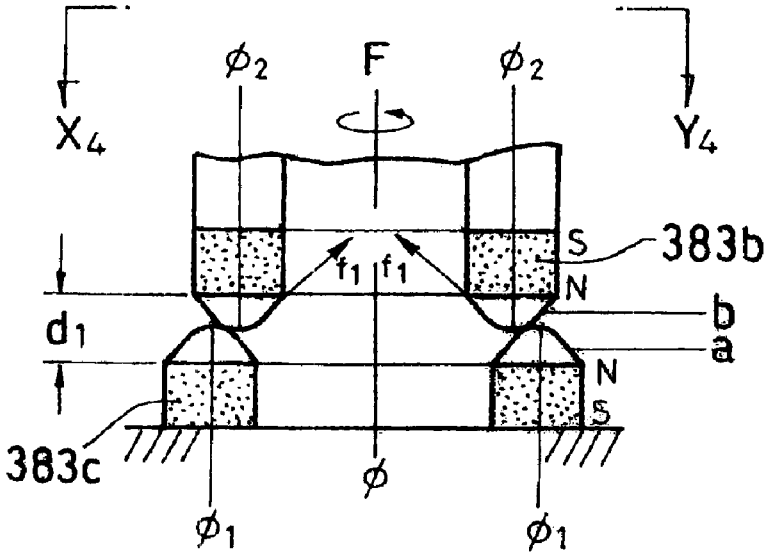
FIGS. 38 through 41 are explanatory diagrams of one example of the magnet mechanism.
Figure 38:
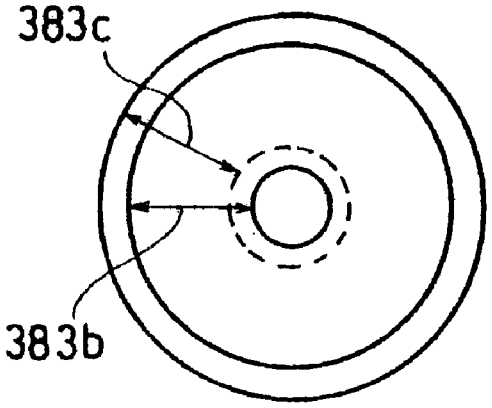

Countered surfaces of a fixed donut-shaped magnet 383*c* and a movable donut-shaped magnet 383*b* have the same polarities so as to repulse each other. Their center lines $\phi$ are aligned with each other tentatively, and inner diameter and outer diameter of the magnet 383*b* are smaller than inner diameter and outer diameter of the magnet 383*c*. Namely, the center lines $\phi$1 and $\phi$2 of the magnet portions of the magnets 383*c* and 383*b* are positioned inside $\phi$1. When the magnet 383*b* is pushed by the force F so as to approach the magnet 383*c*, the repulsion force therebetween gradually increases. However, as shown in FIG. 38, when a distance $d_1$ therebetween is suitably large, the repulsion force is a and b, and the magnet 383*b* tries to move a slantingly central upper direction due to a force $f_1$ so as to return to the normal state.

Figure 39:
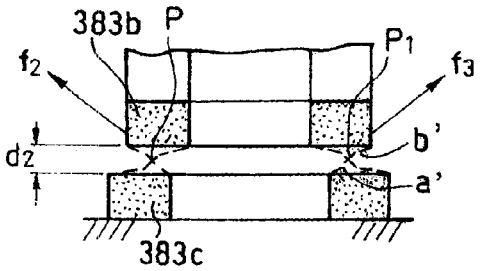

However, in this magnet mechanism, when both the magnets are made to approach each other and the distance $d_2$ becomes gradually narrow, the repulsion force is a' and b' in FIG. 39, and finally the magnets repulse each other at a point P. When the points of both the magnets are slightly shifted from each other in this state, the magnet 383*b* tries to move to a shifted direction ($f_2$, $f_3$).

Figure 40:
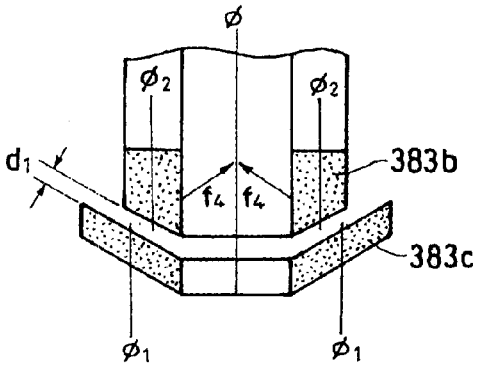

For this reason, as shown in FIG. 40, when the corresponding surfaces of the fixed magnet 383*c* and the movable magnet 383*b* are slanted, a repulsion force $f_4$ of the movable magnet 383*b* always directs inward, the stability of the movement is heightened.

Figure 41:
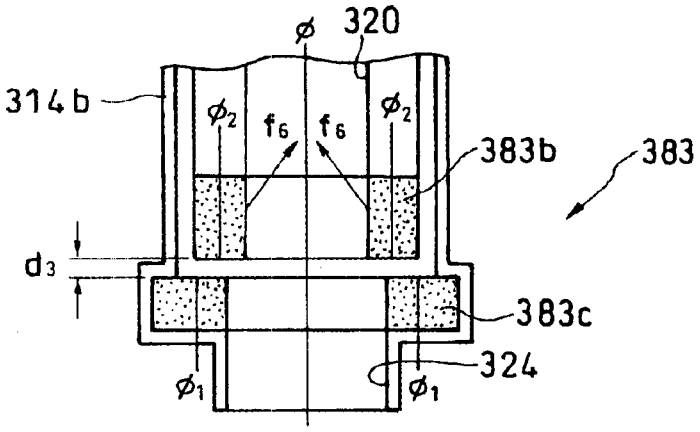

In addition, FIG. 41 is a cross section showing a state that the magnet mechanism 383 is provided to the lower end of the suction passage 320. In FIG. 41, when the outer diameter of the fixed magnet 383*c* is larger than the outer diameter of the movable magnet 383*b*, and a distance between them is secured, the moving direction of the movable magnet 383*b* is an inner side $f_5$ so that the movable magnet 383*b* has a less danger of being shifted from the fixed magnet 383*c*. Moreover, when a suitable vertical external force or rotation is applied to the movable magnet 383*b*, the positional relationship is stabilized. Here, the magnet mechanism 383 has the repulsion force which is enough to support only a weight of the rotating body 313 when the impeller 312 is stopped, and thus when the weight of the rotating body 313 is small, a strong repulsion force is not required. As a result, at the time of idling, the impeller 312 does not contact with the peripheral wall.

The items of the present embodiment will be described below.

1. Outer cylinder 330
   SUS304 cylinder with thickness of about 1 mm
2. Outer cylinder 329
   SUS304 cylinder with thickness of about 1 mm, bottom thickness: 2 mm
3. Magnet of outer magnet cylinder 356
   6 male screw magnets
4. Magnet of inner magnet cylinder 355
   6 male screw magnets 5. Rotor 311
   aluminum cylinder with thickness of 4 mm, inner and outer surfaces coated with glass
6. Magnetic gap
   about 11 mm
7. Impeller 312
   material: acrylic resin, outer diameter: 148 mm ϕ
   magnet mechanism attached
8. Driving motor
   AC220V, 3-phase 2P, 1.5 Kw, Inverter control
   rotation number detecting device and displacement measuring device attached
9. Using liquid
   water: capacity of about 200 L/min, head: about 20 m, pump efficiency: about 50%
10. Gap between rotating body 131 and impeller casing 314*a*
   at the time of stopping: about 1 mm, at the time of operation: about 2 to 3 mm No contact at the time of operation, idling and stopping

Fifth Embodiment

Figure 42:
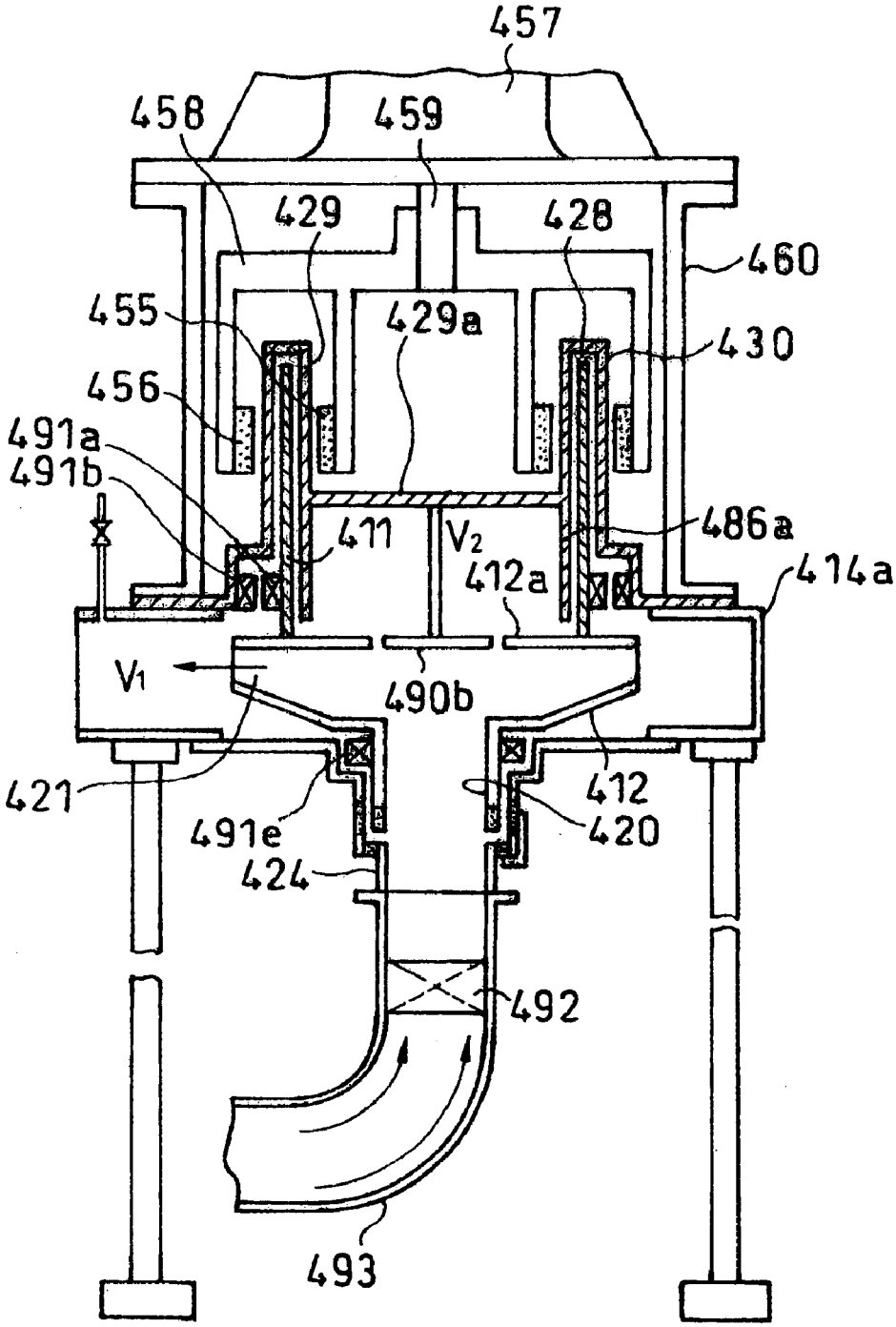
FIG. 42 is an explanatory diagram of the vertical pump according to a fifth embodiment of the present invention.

Next, there will be explained below the fifth embodiment of the present invention with reference to FIG. 42. Here, reference numerals where 400 is added to the numerals in the first embodiment are given to parts corresponding to those shown in the first embodiment, and the description thereof is omitted.

In the present embodiment, a lower end outside of an outer cylinder 430 is connected to an impeller casing section 414*a* by a flange. Moreover, a lower portion of an inner cylinder 429 is extended more downward than an inner bottom plate 429*a* so as to form an outer resistance cylinder 486*a*. A hollow cylindrical rotor 411 with suitable thickness (3 to 4 mm) as a non-magnetic electric good conductor is arranged in a gap between the inner and outer cylinders, and the rotor 411 is rotatable freely in the gap. A gap between the rotor 411 and the inner and outer cylinders is about 2 mm, and a lower end of the rotor 411 is fixed to an impeller main plate 412*a*. Here, a liquid contact portion is coated with anti-corrosion and anti-wear material as the need arises.

Figure 43:
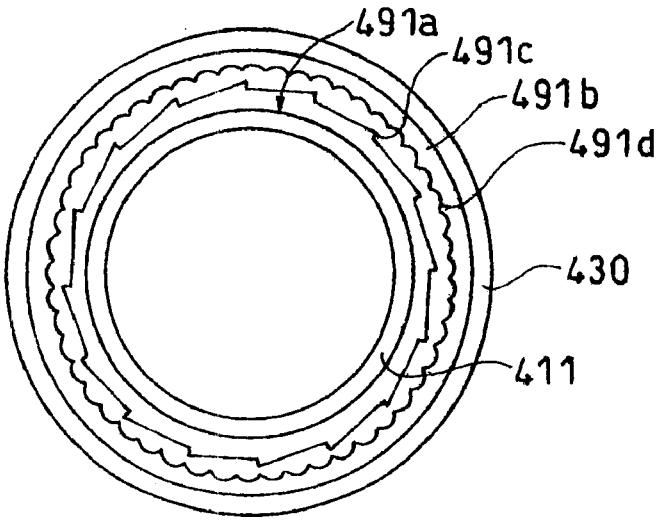
FIGS. 43 through 47 are explanatory diagrams of one example of the Aileron mechanism.
Figure 44:
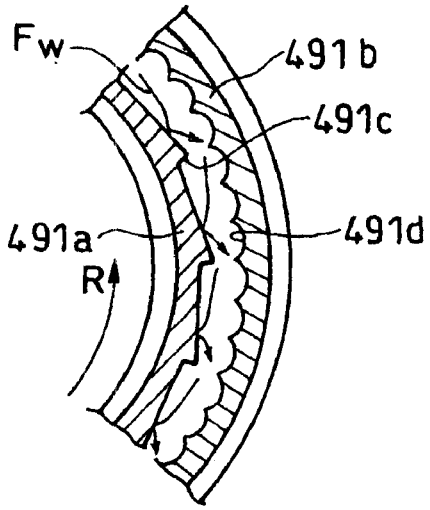

A diameter of the lower portion of the outer cylinder 430 is larger than an upper side. A ring aileron 491*a* is provided on an outer periphery of the rotor slightly above the connected portion of the rotor 411 and the impeller main plate 412*a*, and a corresponding ring 491*b* is provided inside the outer cylinder 430 correspondingly to the aileron 491*a*. The details of the aileron 491*a* and the corresponding ring 491*b* are shown in FIGS. 43 and 44. As is clear from the drawings, a plurality of small vanes 491*c* are carved on the aileron 491*a*, and a plurality of convexo-concaves 491*d* are formed on the corresponding ring 491*b*, and the vanes 941*c* are opposed to the convexo-concaves 49 id via a gap g.

Figure 45:
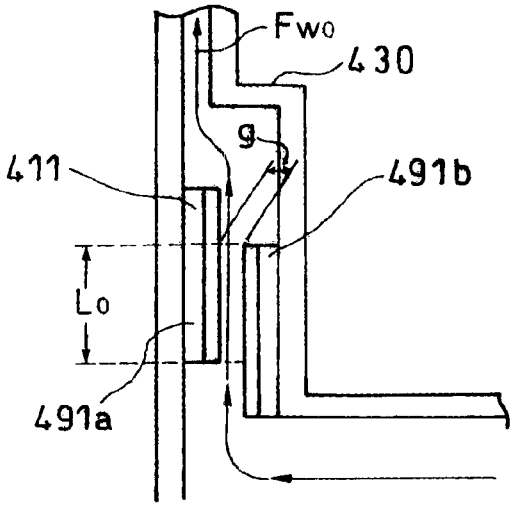
Figure 46:
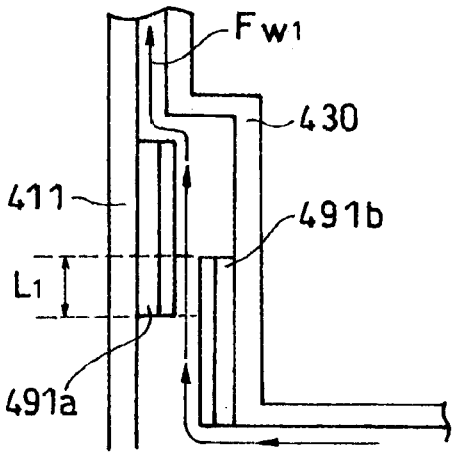
Figure 47:
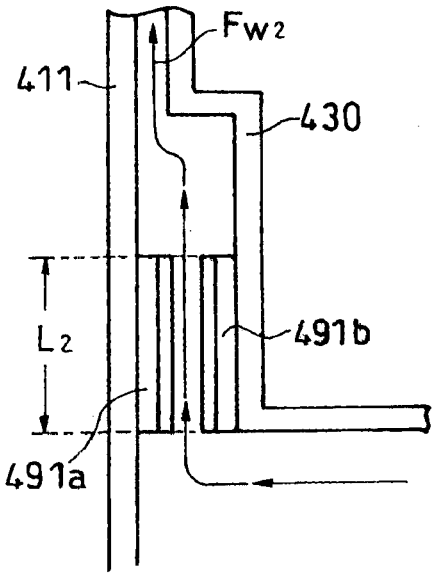
Figure 48:
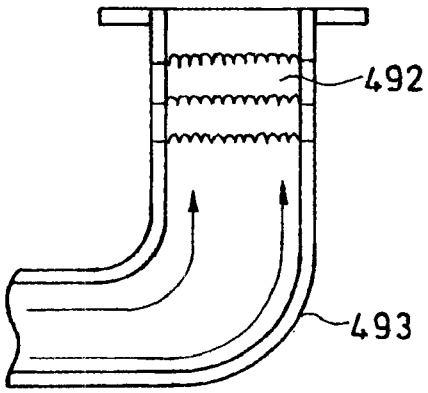
FIG. 48 is an explanatory diagram of a straightening mechanism.

A transfer liquid discharged from an impeller discharge passage 421 passes through the gap g and flows into a space $V_2$ formed in a gap between the impeller main plate 412*a* and the inner bottom plate 429*a*. When the aileron 491*a* rotates, a turbulent flow occurs in the gap g, and flow resistance increases, and an inflow of the transfer liquid into the space $V_2$ is limited. At this time, as a length of the corresponding surfaces of the vanes 491*c* and the convexo-concaves 491*d* is longer, namely, an corresponding area is larger, an inflow into the space $V_2$ is further limited. FIGS. 45 through 47 are diagrams showing a change in the corresponding length of the ailerons 491*a* and the corresponding rings 491*b* due to rise and fall of the impeller 412. FIG. 45 shows a corresponding position in the standard state, and the corresponding length is $L_0$. As shown in FIG. 46, since a corresponding length $L_1$ when the impeller 412 rises is shorter than $L_0$, the fluid resistance is lowered, and an inflow of the transfer liquid into the space $V_2$ increases, and this works to a direction where the impeller 412 is pushed down. Meanwhile, as shown in FIG. 47, when the impeller 412 falls, the corresponding length $L_2$ becomes long, and an inflow of the transfer liquid into the space $V_2$ decreases, and this works to a direction where the impeller 412 is pushed down. As a result, the rotating body 413 is always maintained in a constant position.

In addition, the impeller 412 in the liquid rises and falls by a difference in pressure to be applied to the main plate 412*a* and the lower plate 412*b*. For this reason, when a change of the difference in pressure is within a constant range, the rise and fall of the impeller 412 falls within a constant range, and thus the impeller 412 can be adjusted so as not to contact with the peripheral wall. A second aileron 491*e* whose shape is the same as that of the aileron 491*c* is provided on an outer periphery of the impeller suction passage 420 so as to greatly restrain a flow of reflux to the suction passage 420, and the pressure to be applied to the impeller lower plate 412*b* can be substantially constant. In such a manner, the pressure to be applied to the main plate 412*a*, namely, the pressure in the space $V_2$ is mainly adjusted, an up-and-down fluctuation of the impeller 412 can be restrained within a constant range. Namely, in the case where the impeller 412 falls too far, it is considered that the pressure in the space $V_2$ becomes too strong, and the force which pushes down the impeller 412 becomes too strong. An amount of the liquid entering the space $V_2$ is reduced, and the liquid is refluxed into the impeller from the gap between the main plate 412*a* and the equalizer plate 490*b* so that the pressure in the space $V_2$ is lowered. When the pressure in the space $V_2$ becomes high, a reflux amount increases, and a decrease of the pressure is achieved soon. On the contrary, the pressure in $V_2$ is lowered, the impeller rises. At this time, an inflow of the liquid into the space $V_2$ is increased so that the pressure is heightened. The aileron 491*a* and the corresponding ring 491*b* make this adjustment.

In addition, the aileron 491*a* and the corresponding ring 491*b* functions to prevent the contact between the rotor housing 428 and the rotor 411 by means of a wedge effect due to the liquid in the gap. This is because when the liquid in the pump is once allowed to escape, air is stored at the upper portion of the rotor housing 428, and at the time of actuation, the pressure in the space $V_2$ is lowered due to the air reservoir, and the impeller 412 possibly rises excessively.

In addition, a straightening mechanism 492 is provided on an intake port 424 of the present embodiment. Namely, in the case where the intake port 424 is connected with a liquid feed connection tube 493, when a distance between a curved portion of the connection tube 493 and the impeller 412 is short, a difference between flow rates FWA and FWB generated at the curved portion directly influences the impeller 412, and the impeller 412 is possibly slanted. Therefore, in the present embodiment, the straightening mechanism 492 is provided. As the straightening mechanism 492, it is preferable that two or three nets with rough mesh or punching plates are arranged with intervals. Moreover, there is another method of inserting a tube into a pipe along a flowing direction.

In addition, in the present embodiment, when the pump is stopped, when only the power supply is switched off, as the speed of the impeller 412 becomes lower, oscillation is occasionally generated. When the pump is stopped instantly by reverse braking or brake, the impeller in the stopped state lands soft, and oscillation is hardly generated.

Figure 49:
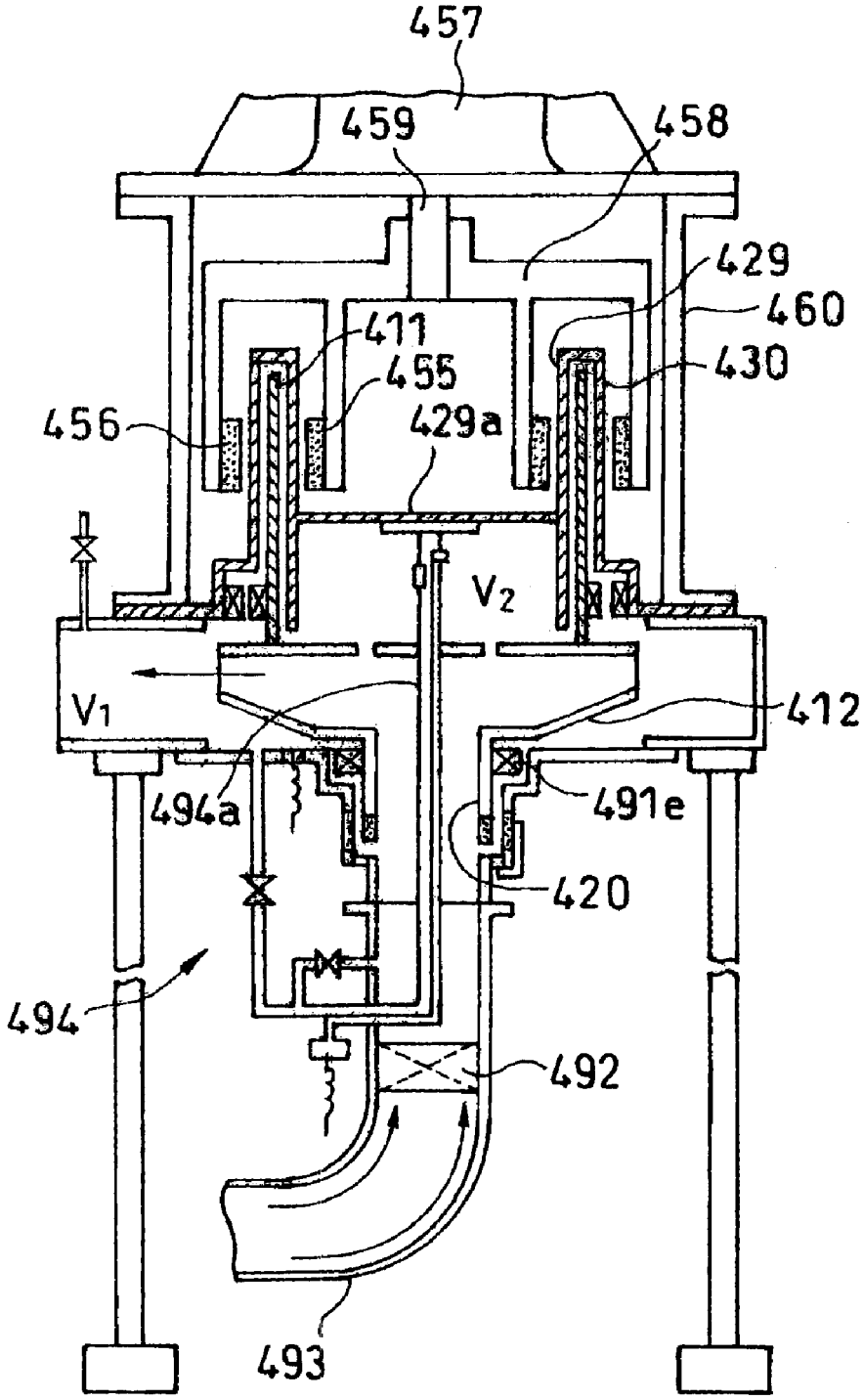
FIG. 49 is an explanatory diagram of a modified example of the fifth embodiment.
Figure 50:
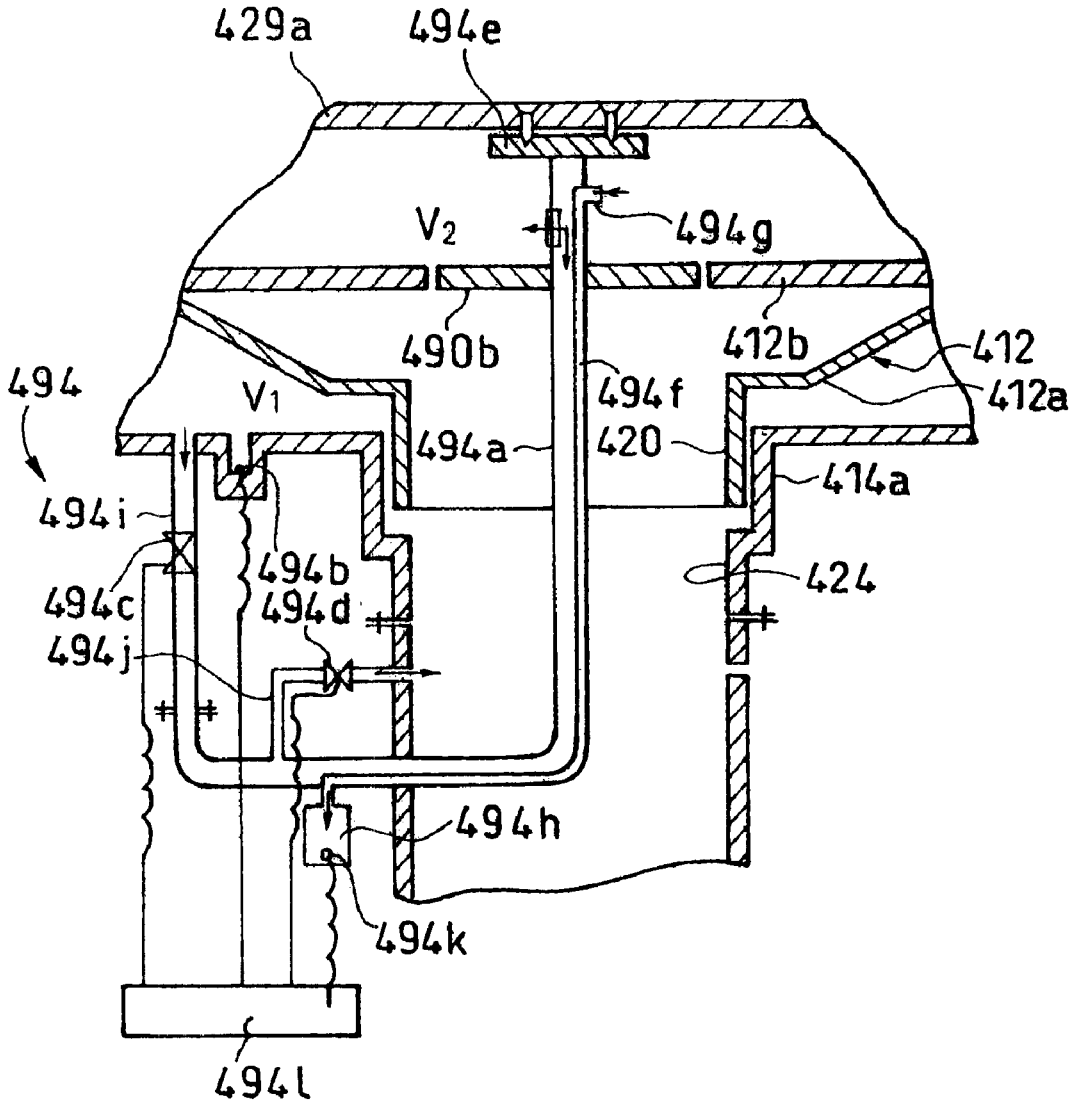
FIG. 50 is an explanatory diagram showing a main section of the pump shown in FIG. 49.

In addition, FIG. 49 shows a state that a pressure adjusting mechanism 494 is provided in the pump as a modified example of the present embodiment, and its main section is enlarged and is shown in FIG. 50.

Namely, in FIG. 50, the pressure adjusting mechanism 494 includes a pressure adjusting tube 494*a*, a detecting head 494*b* of a pressure detector, and on-off valves 494*c* and 494*d*. A attachment flange 494*e* fixed to the upper end of the pressure adjusting tube 494*a* is fixed to an inner bottom plate 429*a* by a screw, and pierces through the center of the equalizer plate 490*b* and the center of the impeller 412 so as to be led out from a side wall of the connecting tube 493. Since the outer diameter of the equalizer plate 490*b* is smaller than the inner diameter of the impeller suction passage 420, the impeller 412 can be pulled out to upward with the adjusting tube 494*a* being connected with the impeller 412. A thin tube 494*f* is inserted into the adjusting tube 494*a*, and outlet hole 494*g* of a liquid in $V_2$ is opened at its upper portion. Moreover, thin tube 494*f* is branched outside the connection tube 493 so as to be connected with the liquid reservoir 494*h*. An lead-in tube 494*i* is pulled out from the inside ($V_1$) of the impeller casing section 414*a*, and a feedback tube 494*j* is pulled out from the connection tube 493, and they are connected with the adjusting tube 494*a* via the on-off valves 494*c* and 494*d*. A concave section is provided on an inner surface of the impeller casing section 414*a*, and a pressure detecting head 494*b* is arranged in the concave section, and a head 494*k* is arranged in the liquid reservoir 494*h*. The detecting head 494*b* can detect a pressure $P_1$ of $V_1$, and the head 494*k* can detect a pressure $P_2$ of $V_2$. Outputs of these valves and the detecting heads are connected to a controller 494*l*.

In the pressure adjusting mechanism 494 which is constituted in the above manner, the controller 4941 compares ($P_1$–$P_2$) with an allowable value δ, and when $P_1-P_2 \ll \delta P$, $P_2$ is increased. For this reason, the on-off valve 494*d* is closed and the on-off valve 494*c* is opened so that a liquid is supplied from $V_1$ via the adjusting tube 494*a* into $V_2$. Moreover, when $P_1-P_2 > \delta P$, $P_2$ is reduced. For this reason, the on-off valve 494*d* is opened and the on-off valve 494*c* is closed so that the liquid is refluxed from $V_2$ via the adjusting tube 494*a* into the suction port 424. The on-off valves 494*c* and 494*d* are controlled automatically by the controller 4941 based on detected results of the detecting heads 494*b* and 494*k*. The pressure adjusting mechanism 494 according to the present embodiment is very effective to stabilize the impeller 412, and it can be used independently or can cooperate with the aileron mechanism or the like.

Here, the concrete items of the vertical pump according to the present embodiment will be described below.

1. Outer cylinder 430 and inner cylinder 429
   resin cylinder with thickness of about 3 mm, bottom thickness: about 5 mm
2. magnet of outer magnet cylinder 456
   6 male screw magnets
3. Magnet of inner magnet cylinder 455
   6 male screw magnets
4. Rotor 411
   anodized aluminum cylinder with thickness of 4 mm, inner and outer surfaces coated with glass
   magnetic gap: about 16 mm
5. Impeller 412
   material: acrylic resin, outer diameter: 125 mm ϕ, magnet mechanism attached
6. Driving motor
   AC220V, 3-phase 2P, 2.2 Kw, with brake
   rotation number detecting device and displacement measuring device attached
7. Using liquid
   water: capacity of about 250 L/min, head: about 22 m, pump efficiency: about 50%
8. Gap between rotating body 413 and impeller casing 414*a*
   at the time of stopping: about 1 mm, at the time of operation: 2 to 3 mm
   No contact at the time of operation, idling and stopping The above embodiment explained using concrete numerals, but the present invention is not limited to this, and the items and the dimensions can be changed.

As explained above, in the vertical pump of the present invention, since the rotating body including the impeller and the cylindrical rotor is rotated without contacting with the outer casing, the pump can be operated without maintenance. Therefore, since foreign matters do not penetrate from a sliding portion into a transfer liquid unlike a conventional bearing type pump, the vertical pump is particularly effective as a biotechnology-use pump and a pure water-use pump which dislike mixing of fine chips.

In addition, as for a clean liquid to be supplied by the clean liquid supply means, a liquid which can be also used as a transfer liquid is used, or a liquid which can be mixed with a transfer liquid may be additionally supplied by a pump or the like.

Further, in the case where the magnetic cylinder is arranged in the cylindrical rotor, the magnetic characteristics are improved, and a stronger rotational force can be applied to the cylindrical rotor in compression with a cylindrical rotor composed of only a good conductor.

The position of a cross sectional centroid of the magnetic cylinder in the up-and-down direction is in a position lower than a center position in the up-and-down direction of a portion where the outer rotation magnetic field generating means and the inner rotation magnetic field generating means face and are lapped on each other. For this reason, when the cylindrical rotor is rotated, the rotating body including the cylindrical rotor rises, and the rotating body can be rotated with it rising in the outer casing regardless of the loaded state and the no-loaded state. Therefore, in the case of the vertical pump, the weight of the rotating body to drop is canceled so that the rotating body can be raised in a liquid, and thus abnormal abrasion and unexpected accident are prevented from occurring.

Particularly lengths of cores in the up-and-down direction which form the magnetic poles of the outer rotation magnetic field generating means and the HXL2 inner rotation magnetic field generating means are the same as each other, and the cores are in the same level. For this reason, the rotation magnetic fields can be generated efficiently.

The lengths of the cores forming the magnetic poles and the magnetic cylinder in the up-and-down direction are equal to each other, and the magnetic cylinder is coaxially embedded from the cylindrical rotor, and the magnetic cylinder is in a center position of the cylindrical rotor in a thickness-wise direction. For this reason, the distances among the cylindrical rotor and the inner rotor and the outer rotor are maintained suitably, and the rotating body can be raised efficiently.

In addition, when a clean liquid is supplied by the clean liquid supply means from the upper portion of the rotor housing of the cylindrical rotor, impurities such as sludge do not penetrate into the rotor housing, and abrasion among the cylindrical rotor, the inner cylinder and the outer cylinder is extremely small. As a result, the vertical pump has a long life.

Further, when the clean liquid supply means is provided with the filter which filtrates a transfer liquid discharged from the discharge port, the filtrated transfer liquid is used so that a special liquid or pump is not required.

Moreover, when the rotation magnetic field generating means is composed of the inner stator and the outer stator which generate rotation magnetic fields by flowing alternating current and are arranged to face each other, a rotating portion other than the rotating body is eliminated. Further, since a bearing and a seal member are not used in the rotating body, the vertical pump having longer life can be provided.

In addition, the cooling tank where the inner stator and the outer stator are cooled by an insulating liquid is provided, and the cooling means for cooling the insulating liquid is provided in the cooling tank. For this reason, a heat which is generated inside can be allowed to escape outside, and the more smaller vertical pump can be provided.

Further, the cooler and the circulating pump of the insulating liquid are provided in the cooling means for cooling the inner stator so that the inner stator can be cooled efficiently.

Moreover, since the rotation magnetic field generating means is composed of the magnets which are driven by the motor, the magnet pump having long life using a general motor can be provided.

In addition, since the impeller casing section forming the impeller chamber can be removed and the rotating body can be removed from the impeller and the cylindrical rotor, cleaning and inspection become easy.

Further, the first annular magnet is provided to the upper portion of the impeller, and the second annular magnet which repulses the first annular magnet is provided to the lower portion of the inner bottom plate of the inner cylinder facing the upper portion of the impeller. As a result, the contact between the impeller and the inner bottom plate can be prevented.

We claim:

1. A vertical pump, comprising:

a rotating body having an impeller arranged with its axial center being vertical, and a cylindrical rotor having an axial center fixed on said impeller with their axial centers being aligned with each other, a main portion of said cylindrical rotor being composed of a good conductor;

a casing for housing said rotating body with a gap which allows the rotating body to rotate; and a rotary magnetic field generator for applying a rotational force to said cylindrical rotor, said rotary magnetic field generator facing said cylindrical rotor, wherein said rotating body including said impeller and said cylindrical rotor are rotated without contacting with said casing.

2. The vertical pump according to claim 1, wherein said casing includes:

an impeller chamber having a suction port at its center and a discharge port at its side portion, said impeller chamber for storing said impeller; and a rotor housing having an inner cylinder and an outer cylinder made of non-magnetic high-electric resistant materials, and a cover section for covering said cylinders, said cylindrical rotor being arranged to rotate in a gap between said inner cylinder and said outer cylinder, said rotor housing being connected integrally with said impeller chamber.

3. The vertical-pump according to claim 2, wherein said rotary magnetic field generator includes an inner rotation magnetic field generator and outer rotation magnetic field generator, for applying rotational forces to said cylindrical rotor, which are arranged so as to respectively face an outer side of said outer cylinder and an inner side of said inner cylinder.

4. The vertical pump according to claim 1, wherein a magnetic cylinder is arranged on said cylindrical rotor concentrically, and an up-and-down position of a cross sectional centroid of the magnetic cylinder in the state that said cylindrical rotor is stopped is in a center position of said rotary magnetic field generator in an up-and-down direction, and wherein when said cylindrical rotor is rotated the rotating body including said cylindrical rotor rises.

5. The vertical pump according to claim 3, wherein lengths of cores in an up-and-down direction forming polarities of said outer rotation magnetic field generator and said inner rotation magnetic field generator are the same, and the generators are at the same level, and lengths of the cores and said magnetic cylinder in the up-and-down direction are equal to each other, and said magnetic cylinder is embedded concentrically in said cylindrical rotor, and said magnetic cylinder is in a thickness-wise center position of said cylindrical rotor.

6. The vertical pump according to claim 2, wherein clean liquid supply means having an introduction hole is provided to an upper position of said rotor housing so as to supply a clean liquid from an upper portion of said rotor housing.

7. The vertical pump according to claim 2, wherein a clean liquid supply means has a filter which filters a transfer liquid discharged from the discharge port of said casing wherein the transfer liquid filtered by the filter is supplied to the upper portion of the rotor housing.

8. The vertical pump according to claim 1, wherein an inner rotation magnetic field generator and an outer rotation magnetic field generator are composed of an inner stator and an outer stator which allow alternating currents to flow so as to generate rotary magnetic fields.

9. The vertical pump according to claim 8, wherein a cooling tank where she inner stator and the outer stator are cooled by an insulating liquid is provided, and a cooler for cooling the insulating liquid is provided to the cooling tank.

10. The vertical pump according to claim 9, further comprising a circulating pump for the insulating liquid.

11. The vertical pump according to claim 3, wherein said inner rotation magnetic field generator and said outer rotation magnetic field generator are composed of an inner magnet and an outer magnet which are rotated by a motor, and said motor applies a rotational force to said cylindrical rotor.

12. The vertical pump according to claim 2, wherein a bottom plate which is supported by a supporting cradle is provided on said rotor housing, and an impeller casing section, which covers said impeller so as to form said impeller chamber is attached to the bottom plate in a covered state.

13. The vertical pump according to claim 1, wherein a first annular magnet is provided on the upper portion of said impeller, and a second annular magnet which repulses said first annular magnet is provided on said casing facing the upper portion of said impeller.

14. The vertical pump according to claim 1, further comprising:

a movable annular magnet arranged on said lower portion of said impeller; and a fixed annular magnet arranged on said casing and facing said movable annular magnet, wherein said movable annular magnet and said fixed annular magnet repulse each other.

15. The vertical pump according to claim 1, wherein an aileron is formed on an upper portion of said impeller which pushes out a liquid at an upper portion of said impeller by rotation of said impeller.

16. The vertical pump according to claim 2, wherein a resistant cylinder which projects downward is formed on a lower surface of said rotor housing.

17. The vertical pump according to claim 2, comprising an impeller main plate which has an opening whose center is a rotational axis of the plate, and an equalizer plate which is hung from a lower surface of said rotor housing is provided on the opening.

18. The vertical pump according to claim 1, further comprising:

a movable aileron which is projected from said rotating body to a peripheral direction: and a fixed aileron which is projected from said casing inwardly are provided, wherein an area of countered portions of said movable aileron and said fixed aileron changes by up-and-down movement of said impeller, and when said impeller moves upward, the area of the countered portions decreases and a transfer amount of the liquid into the upper portion of said impeller increases, and when said impeller moves downward, the area of the countered portions increases and a transfer amount of the liquid into the upward portion of said impeller decreases.

19. The vertical pump according to claim 1, comprising:

an upper pressure sensor for detecting a liquid pressure on the upper portion of said impeller;

a lower pressure sensor for detecting a liquid pressure between the lower portion of said impeller and said impeller casing section;

a pressure adjusting tube for, when a difference $(P_1-P_2)$ between the upper pressure $P_1$ and the lower pressure $P_2$ becomes larger than a fixed value $\delta P$, discharging the liquid on the upper portion of said impeller, and when the difference $(P_1-P_2)$ becomes smaller than the fixed value $\delta P$, feeding a liquid to the upper portion of said impeller; and a controller for controlling the discharge and feeding by means of said pressure adjusting tube.

20. The vertical pump according to claim 1, wherein an aileron which rotates with said impeller is formed below said impeller, and said aileron is opposed to said casing with a first gap between the aileron and the casing, wherein by rotation of said impeller, liquid pressure in a gap between a lower portion of the impeller and said casing increases, which causes said lower portion of the impeller to be pushed up, and which causes said rotating body including said impeller to rise upward in said casing.

21. The vertical pump according to claim 20, wherein by said rotation of the impeller, discharged fluid from said impeller flows into the gap between said lower portion of the impeller and said casing, and by said rotation of the aileron, the fluid flow resistance in said first gap between said aileron and said casing increases, which causes the liquid pressure in the gap between said lower portion of the impeller and said casing to be increased more than liquid pressure on an upper portion of said impeller, which causes said rotating body including said impeller to rise upward in said casing.

22. The vertical pump according to claim 20, wherein said first gap between the aileron and casing which is formed at a lower portion of impeller and casing;

wherein when said impeller moves upward, said first gap increases, and said liquid pressure in said first gap decreases, and wherein when said impeller moves downward, said first gap decreases, and said liquid pressure in said first gap increases.

23. The vertical pump according to claim 20, wherein a change of difference in pressure for said impeller is controlled by a force which pushes down said impeller, wherein said force which pushes down is obtained by liquid pressure on an upper portion of said impeller and wherein a force which pushes up said lower portion of said impeller is obtained by said liquid pressure in the gap between a lower portion of said impeller and the casing, and wherein said impeller rotates without contacting in said casing.

24. The vertical pump according to claim 20, wherein a second aileron which pushes out a liquid at the upper portion of said impeller by rotation of said impeller is formed on an upper portion of said impeller, wherein said second aileron formed on upper portion of impeller is opposed to said casing to form a second gap, wherein said second gap is formed between the upper portion of the impeller and the casing changes by up-and-down by movement of said impeller, and, wherein when said impeller moves upward, said second gap between the second aileron formed on upper portion of impeller and the casing decreases, and wherein when said impeller moves downward, said second gap between the second aileron formed on the upper portion of the impeller and the casing increases.

* * * * *